US008550323B2

(12) United States Patent
Fujimoto

(10) Patent No.: US 8,550,323 B2
(45) Date of Patent: Oct. 8, 2013

(54) DRIVING TOOL

(75) Inventor: Yasuyuki Fujimoto, Anjo (JP)

(73) Assignee: Makita Corporation, Aichi (JP)

( * ) Notice: Subject to any disclaimer, the term of this patent is extended or adjusted under 35 U.S.C. 154(b) by 373 days.

(21) Appl. No.: 13/080,922

(22) Filed: Apr. 6, 2011

(65) Prior Publication Data

US 2011/0248062 A1 Oct. 13, 2011

(30) Foreign Application Priority Data

Apr. 9, 2010 (JP) ..... 2010-090719

(51) Int. Cl.

| | |
|---|---|
| ***B21J 15/28*** | (2006.01) |
| ***B27F 7/17*** | (2006.01) |
| ***B27F 7/00*** | (2006.01) |
| ***B25C 1/00*** | (2006.01) |
| ***B25C 5/02*** | (2006.01) |
| ***B25C 5/06*** | (2006.01) |

(52) U.S. Cl.
USPC ..... 227/132; 227/8

(58) Field of Classification Search
USPC ..... 227/1–8; 173/170
See application file for complete search history.

(56) References Cited

U.S. PATENT DOCUMENTS

| | | | | |
|---|---|---|---|---|
| 4,042,036 | A * | 8/1977 | Smith et al. | 173/13 |
| 4,121,745 | A * | 10/1978 | Smith et al. | 227/8 |
| 4,129,240 | A * | 12/1978 | Geist | 227/8 |
| 4,189,080 | A * | 2/1980 | Smith et al. | 227/8 |
| 4,964,558 | A * | 10/1990 | Crutcher et al. | 227/8 |
| 5,098,004 | A * | 3/1992 | Kerrigan | 227/134 |
| 6,971,567 | B1 | 12/2005 | Cannaliato et al. | |
| 7,575,141 | B1 * | 8/2009 | Liang et al. | 227/131 |
| 7,575,142 | B2 * | 8/2009 | Liang et al. | 227/133 |
| 8,336,748 | B2 * | 12/2012 | Hlinka et al. | 227/8 |
| 2009/0250500 | A1 * | 10/2009 | Brendel et al. | 227/132 |

* cited by examiner

*Primary Examiner* — Robert Long
(74) *Attorney, Agent, or Firm* — Oliff & Berridge, PLC

(57) ABSTRACT

A technique is provided which contributes to improvement in workability in a driving tool.

The driving tool includes a cam switching member 183 and a driving mechanism 115. The cam switching member 183 normally holds a cam member 137 in an inoperative position, and when a user's driving operation is performed, it performs a switching movement to move the cam member 137 from the inoperative position to an operative position and further to return the cam member 137 from the operative position to the inoperative position. When the earn member 137 moves from the inoperative position to the operative position, the earn member 137 moves a driving member 133 for the driving mechanism to a first position in a direction of a rotational axis of a rotating member 131. At this time, the driving mechanism 115 mechanically engages with the driving member 133 for the driving mechanism in the first position and performs a movement of driving a material to be driven. When the user's driving operation is performed, the cam switching member 183 is moved to a connection standby position in which the cam switching member 183 can be connected to a rotationally driven element 179 which rotates together with the rotating member 131. Further, when the driving member 133 for the driving mechanism is placed in a predetermined rotational angular position in the direction of rotation of the rotating member 131, the cam switching member 183 is connected to the rotationally driven element 179.

11 Claims, 34 Drawing Sheets

DRIVING TOOL

BACKGROUND OF THE INVENTION

1. Field of the Invention

The invention relates to a driving tool for driving a material to be driven such as a nail into a workpiece.

2. Description of the Related Art

U.S. Pat. No. 6,971,567 discloses a driving tool. The known driving tool includes a flywheel mechanism which is rotationally driven by a motor and a driving mechanism for driving a material to be driven such as a nail into a workpiece. The flywheel mechanism has a flywheel, a driving pin which is mounted to the flywheel and can move back and forth in a direction of a rotational axis of the flywheel, and a disc-like cam plate which protrudes the driving pin from a side of the flywheel and connects it to the driving mechanism. When a motor is driven by depressing a trigger, the flywheel and the cam plate rotate in the same direction at a predetermined speed reducing ratio. Then by utilizing a difference in rotational speed which is caused between the flywheel and the cam plate by this rotation, the driving pin is protruded via a slope formed in the cam plate and having a predetermined length in a circumferential direction. The protruded driving pin is mechanically connected to the driving mechanism, so that the driving mechanism drives a material to be driven.

In the above-described known driving tool, the motor must be driven for each nailing operation, and the nail driving movement is performed by utilizing kinetic energy of the flywheel, so that it takes a predetermined time from start of the motor to start of the movement of driving a material to be driven. Therefore, in terms of workability of the driving tool, further improvement is desired.

SUMMARY OF THE INVENTION

Accordingly, it is an object of the invention to improve workability in a driving tool.

Above-described object can be achieved by the claimed invention. In a preferred embodiment according to the invention, a driving tool includes a motor, a rotating member, a driving member for a driving mechanism, a biasing member, a cam member, a cam switching mechanism and a driving mechanism. The rotating member is constantly rotationally driven by the motor. The motor is driven, for example, by turning on an electric switch for starting the motor. The driving member for the driving mechanism is disposed in the rotating member in a position displaced a predetermined distance from a rotational axis of the rotating member and can be moved in a direction of the rotational axis. Further, the driving member is caused to move between a first position and a second position different from the first position in the direction of the rotational axis. The biasing member biases the driving member for the driving mechanism in such a manner as to hold it in the second position. The biasing member comprises an elastic element such as a spring and rubber. The cam member can be moved between an inoperative position and an operative position in a direction transverse to a direction of movement of the driving member for the driving mechanism. When the cam member moves from the inoperative position to the operative position, the cam member comes in contact with a predetermined area of the driving member in the longitudinal direction which revolves around the rotational axis of the rotating member and moves the driving member for the driving mechanism to the first position against the biasing force of the biasing member. When the cam member moves from the operative position to the inoperative position, the cam member allows the driving member for the driving mechanism to be moved to the second position by the biasing member. Further, the manner in which "the cam member moves between the inoperative position and the operative position" in the invention suitably includes not only the manner in which the cam member linearly moves, but also the manner in which it moves in an arc. When a user's driving operation is performed, the cam switching mechanism performs a switching movement to move the cam member from the inoperative position to the operative position and further to return it from the operative position to the inoperative position. The "user's driving operation" here represents an action to be taken by the user to perform a nailing operation, or more specifically, user's action of operating one or more operating members for starting the nailing operation. When the cam member is placed in the operative position, the driving member for the driving mechanism is moved to the first position in the direction of the rotational axis of the rotating member by the cam member, and the driving mechanism mechanically engages with the driving member and performs a movement of driving a material to be driven.

According to the driving tool constructed as described above, when the rotating member having the driving member for the driving mechanism is rotationally driven by the motor and the cam member is placed in the inoperative position, the driving member for the driving mechanism is held in the second position by the biasing member. When the cam switching mechanism is actuated in this state and the cam member is moved from the inoperative position to the operative position, one end of the driving member in the longitudinal direction which is caused to revolve around the rotational axis of the rotating member by rotation of the rotating member comes in contact with the cam member placed in the operative position. Thus, the driving member for the driving mechanism is moved from the second position to the first position against the biasing force of the biasing member. Specifically, the driving member for the driving mechanism is pushed up from the second position to the first position by a cam lift of the cam member. Then the driving member revolving in the first position mechanically engages with the driving mechanism held in its standby state, so that the driving mechanism performs a movement of driving the material to be driven. Specifically, according to the invention, the driving mechanism can continuously perform the movement of driving the material to be driven by repeating the switching movement of the cam member between the inoperative position and the operative position via the cam switching mechanism while the rotating member is held constantly rotating. Thus, the movement of continuously driving the material to be driven, or continuous nailing can be realized and the working efficiency can be improved.

The preferred embodiment of the invention is characterized in that the cam switching mechanism has a rotationally driven element which is rotated together with the rotating member and a cam switching member. The cam switching member can be connected to and disconnected from the rotationally driven element. When the cam switching member is connected to the rotationally driven element, the cam switching member performs a switching movement to convert rotation of the rotationally driven element to linear motion and move the cam member from the inoperative position to the operative position and further to return it from the operative position to the inoperative position. When the cam member is returned to the inoperative position, the cam switching member is disconnected from the rotationally driven element. When the user's driving operation is performed, the cam switching member is moved to a connection standby position in which it can be connected to the rotationally driven element. Further, when the driving member for the driving mechanism is placed in a predetermined rotational angular position in the direction of rotation of the rotating member, the cam switching member is connected to the rotationally driven element.

According to the invention, in the state in which the rotating member is rotationally driven by the motor, when the user's driving operation is performed, the cam switching member is moved to the connection standby position in order to prepare for connection with the rotationally driven element. Then, when the driving member for the driving mechanism which revolves around the rotational axis of the rotating member is placed in a predetermined rotational angular position, the cam switching member is connected to the rotationally driven element. Therefore, the timing of connection between the cam switching member and the rotationally driven element is held constant with respect to the rotational angular position of the driving member which revolves around the rotational axis of the rotating member, regardless of the timing of user's driving operation. Therefore, it is not necessary to control the timing of user's driving operation, so that stable driving movement can be realized. Further, the "predetermined rotational angular position" is set such that, at the time when the driving member for the driving mechanism is placed in an engagement position in which it is engaged with the driving mechanism in the direction of rotation of the rotating member, the cam member is already placed in the operative position and causes the driving member for the driving mechanism to protrude a predetermined length from the side of the rotating member, so that the driving member for the driving mechanism is engaged with the driving mechanism.

According to a further embodiment of the driving tool in the invention, the rotationally driven element comprises a flat cam having a side with a cam groove. Further, the cam switching member is normally placed in an initial position in which it is disconnected from the cam groove. When the user's driving operation is performed, the cam switching member is moved from the initial position to the connection standby position in which it can be connected to the cam groove. Further, when the driving member for the driving mechanism is placed in the predetermined rotational angular position, the cam switching member is connected to the cam groove.

According to this invention, with the construction in which the rotationally driven element is formed by the flat cam having the side with the cam groove, connection and disconnection between the flat cam and the cam switching member can be reliably performed.

According to a further embodiment of the driving tool in the invention, the driving tool has a connecting part for connecting the cam member and the cam switching member, and the connecting part has a play region in which the switching movement of the cam switching member is not transmitted to the cam member while the cam switching member is moved from the initial position to the connection standby position. The "play region" is formed by a region in which, for example, in the case of a construction in which the cam member and the cam switching member are connected by a pin, the pin can move in the direction of movement of the cam member and the cam switching member without being restrained by at least either one of the cam member and the cam switching member.

According to this invention, with the construction in which the play region is provided between the cam member and the cam switching member and allows the cam member and the cam switching member to move with respect to each other, the stroke of the cam member is reduced, so that space savings within the driving tool can be realized.

According to a further embodiment of the driving tool in the invention, the cam switching member is designed to be moved between the initial position and the connection standby position in a direction parallel to the side of the flat cam and has a cam follower in an area opposed to the side of the flat cam. The cam follower can move in the direction of the rotational axis of the flat cam and is constantly pressed and biased toward the side of the flat cam. The driving tool further has a releasing means. When the cam switching member is moved to the initial position, the releasing means disconnects the cam follower from the side of the flat cam and holds it in the disconnected position. When the cam switching member is moved to the connection standby position, the releasing means releases the cam follower held in the disconnected position.

According to this invention, when the cam switching member is placed in the initial position, the cam follower is disconnected from the side of the flat cam so as to avoid contact with the flat cam. Thus, noise which may be caused by contact of the cam follower with the flat cam can be prevented.

According to a further embodiment of the driving tool in the invention, the cam follower is supported to the cam switching member and can rotate around its longitudinal axis.

According to the invention, with the construction in which the cam follower can rotate around the longitudinal axis, when the cam follower is engaged with the cam groove and relatively moves along the cam groove, partial contact of the cam follower with the wall surface of the cam groove can be avoided and wear of the cam follower on one side can be prevented.

According to a further embodiment of the driving tool in the invention, the cam member has a protrusion which protrudes in a direction transverse to the direction of its movement. Further, the rotating member has a protrusion which protrudes in a direction of its rotational axis. When the cam member is locked in the operative position even though the cam switching member is returned to the initial position, the protrusion of the rotating member comes in contact with the protrusion of the cam member and forcibly moves the cam member to the inoperative position.

According to this invention, with the construction in which the cam member can be forcibly returned to the inoperative position by contact (interference) between the rotating member side protrusion and the cam switching member side protrusion, continuous nailing can be prevented which may be caused if the cam member is locked in the operative position for any reason such as malfunction of the cam switching member.

According to a further embodiment of the driving tool in the invention, the driving tool has a spring member which constantly biases the cam member in order to move the cam member from the operative position to the inoperative position. When the cam member is locked in the operative position even though the cam switching member is returned to the initial position, the cam member is forcibly moved to the inoperative position by the spring member.

According to this invention, with the construction in which the cam member can be forcibly returned to the inoperative position by the spring member, continuous nailing can be prevented which may be caused if the cam member is locked in the operative position for any reason such as malfunction of the cam switching member.

According to a further embodiment of the driving tool in the invention, the cam switching mechanism further has a movable member, a connecting member and a switching mechanism. The movable member moves the cam switching member from the initial position to the connection standby position by moving in one direction when the user's nail driving operation is performed. The connecting member is placed in a third position in which the movable member and the cam switching member are integrated, and when the cam switching member is connected to the flat cam, the connecting member can be displaced from the third position to a fourth position while allowing the movable member and the cam switching member to move with respect to each other. The switching mechanism holds the connecting member in the third position when the movable member is moved in one direction, and the switching mechanism moves the connecting member from the third position to the fourth position when the cam switching member is connected to the flat cam and performs the switching movement.

According to the invention, the cam switching member is integrated with the movable member by the connecting member placed in the third position until the user performs a driving operation. Therefore, when the user performs the driving operation, the cam switching member is moved from the initial position to the connection standby position. Then, when the cam switching member in the connection standby position is connected to the flat cam and switched, the connecting member is moved to the fourth position by the switching mechanism, so that the cam switching member is allowed to move with respect to the movable member. Therefore, movement of the cam switching member from the initial position to the connection standby position at the time when user's driving operation is performed and further movement of the cam switching member for switching the cam member can be smoothly performed.

According to a further embodiment of the driving tool in the invention, provided that the cam switching mechanism has the movable member, the connecting/member and the switching mechanism, the driving tool has a retaining means and a biasing member which biases the connecting member to be moved from the fourth position to the third position. Until the cam switching member is disconnected from the flat cam and returned to the initial position and the movable member is returned to an initial state by releasing of the user's driving operation, the retaining means retains the connecting member in the fourth position. When the movable member is returned to the initial state, the retaining means allows the connecting member to move to the third position.

According to the invention, unless the user's driving operation is released, the connecting member is held in the fourth position by the retaining means. In other words, the driving movement of the driving tool can be performed only when the user performs the driving operation again after once releasing the driving operation. Therefore, even if the user's driving operation is continued, the nailing operation is not continuously performed.

According to the invention, a technique that contributes to improvement of workability in a driving tool is provided. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved driving tools and method for using such driving tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
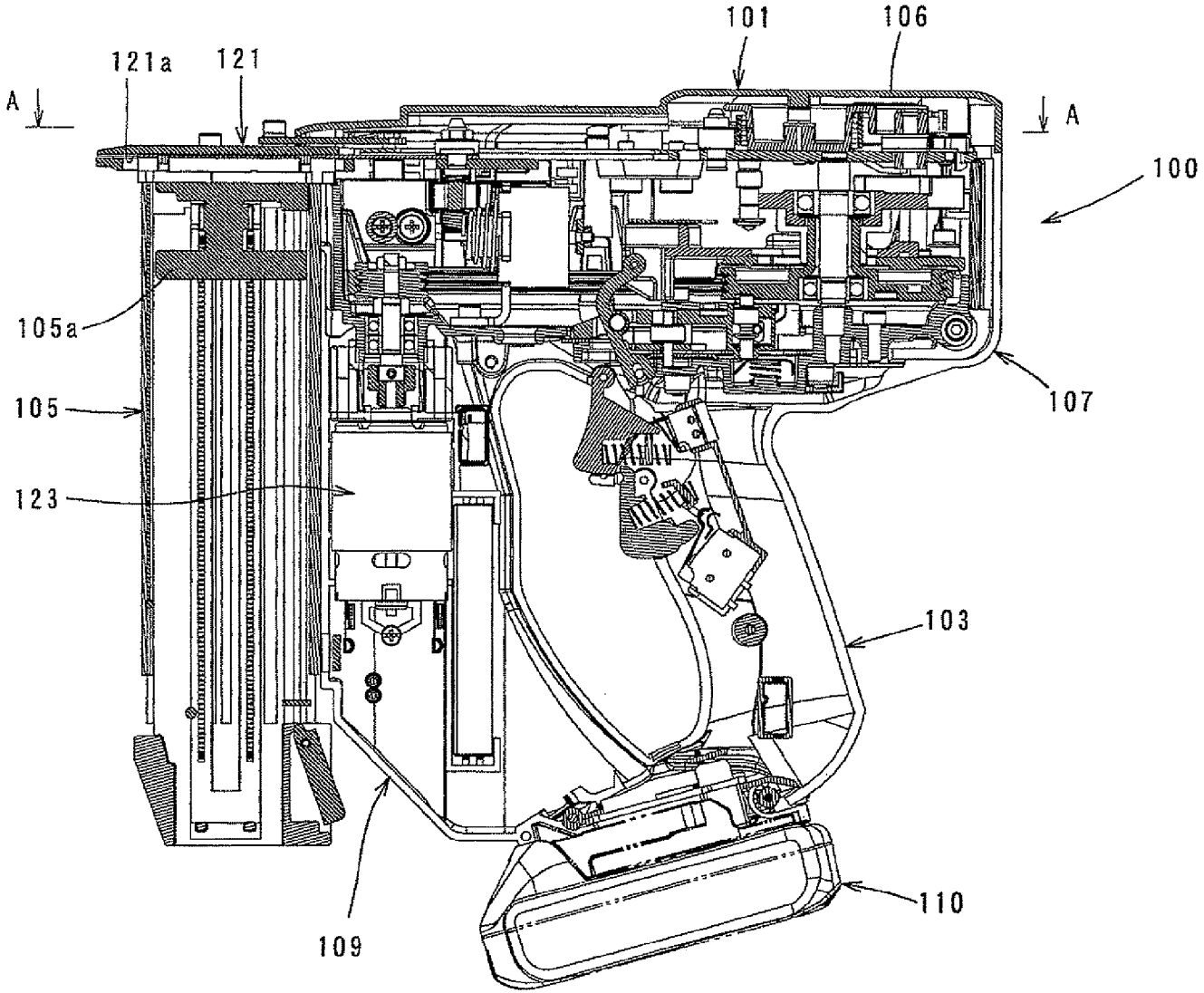
FIG. 1 is a sectional view showing an entire construction of a nailing machine according to this embodiment.
Figure 2:
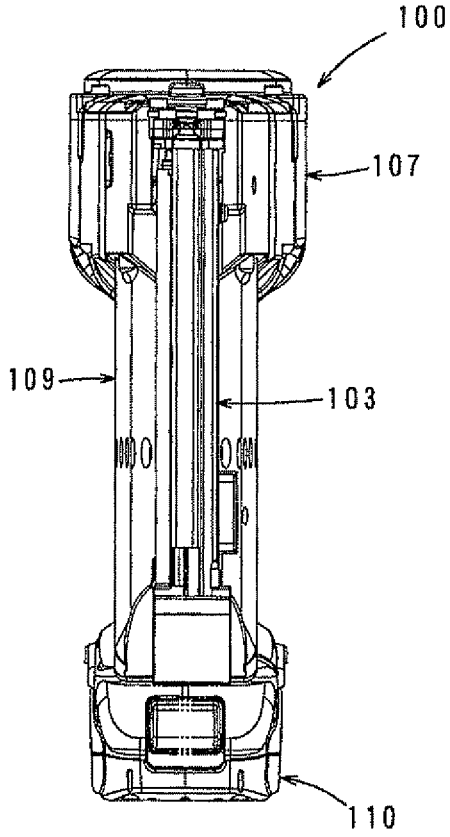
FIG. 2 is right side view of FIG. 1.
Figure 3:
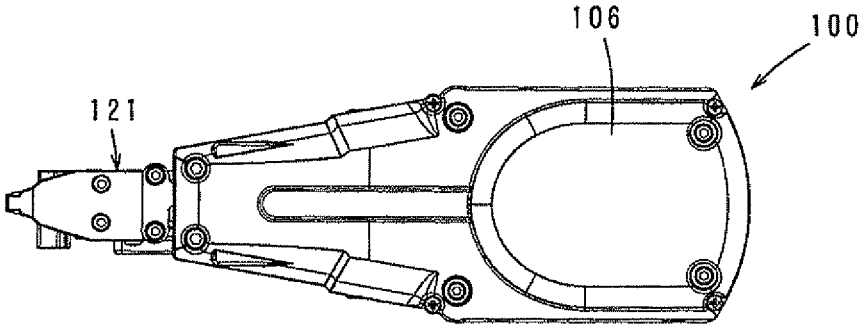
FIG. 3 is a plan view of FIG. 1.

An embodiment of the invention is now described with reference to the drawings. In this embodiment, a battery-powered nailing machine 100 is explained as a representative example of a driving tool according to the invention. As shown in FIGS. 1 to 3, the nailing machine 100 mainly includes a body 101 that forms an outer shell of the nailing machine 100, a handle 103 to be held by a user, and a magazine 105 that is loaded with materials in the form of nails to be driven into a workpiece. The handle 103 is integrally fanned with the body 101 and extends from the side of the body 101 in a lateral direction (downward direction as viewed in FIG. 1) transverse to a longitudinal direction of the body 101 (the horizontal direction as viewed in FIG. 1). A rechargeable battery pack 110 is mounted on an extending end (lower end as viewed in FIG. 1) of the handle 103, and a driving motor 123 is powered from the rechargeable battery pack 110. The driving motor 123 is a feature that corresponds to the "motor" according to the invention.

FIG. 1 shows the nailing machine 100 pointed to the left with the front end of the body 101 pointed at a workpiece. Therefore, a nail driving direction (the longitudinal direction of the body 101) in which a nail is driven and a nail striking direction in which a driver 141 strikes the nail are a leftward direction in FIG. 1.

A driver guide 121 is provided on the front end (the left end as viewed in FIG. 1) of the body 101 and forms a nail injection port. The magazine 105 is disposed on the front end region of the body 101 and extends generally parallel to the handle 103. One end of the magazine 105 on the nail feeding side is connected to the driver guide 121 and the other end is connected to the extending end region of the handle 103. Further, the magazine 105 has a pressure plate 105*a* for pushing nails in the nail feeding direction (upward as viewed in FIG. 1). The magazine 105 is designed such that the nails are fed one by one into a nail injection hole 121*a* of the driver guide 121 from a direction transverse to the nail driving direction by the pressure plate 105*a*. The nail injection hole 121*a* is formed through the driver guide 121 in the nail driving direction. For the sake of convenience of explanation, the front end side of the body 101 in the longitudinal direction (the left as viewed in FIG. 1) is taken as the front and its opposite side is taken as the rear. Further, the handle 103 side (the lower side as viewed in FIG. 1) of the body 101 in a direction transverse to the longitudinal direction is taken as the back side and its opposite side is taken as the front side.

As shown in FIG. 1, the body 101 mainly includes a generally cylindrical resin body housing 107 and a motor housing 109 which houses the driving motor 123. The motor housing 109 is provided adjacent to the magazine 105 on a front end region of the body housing 107 and connected to the body housing 107. The driving motor 123 is driven when a motor-driving first electronic switch 163 which is disposed in the handle 103 is turned on.

Figure 5:
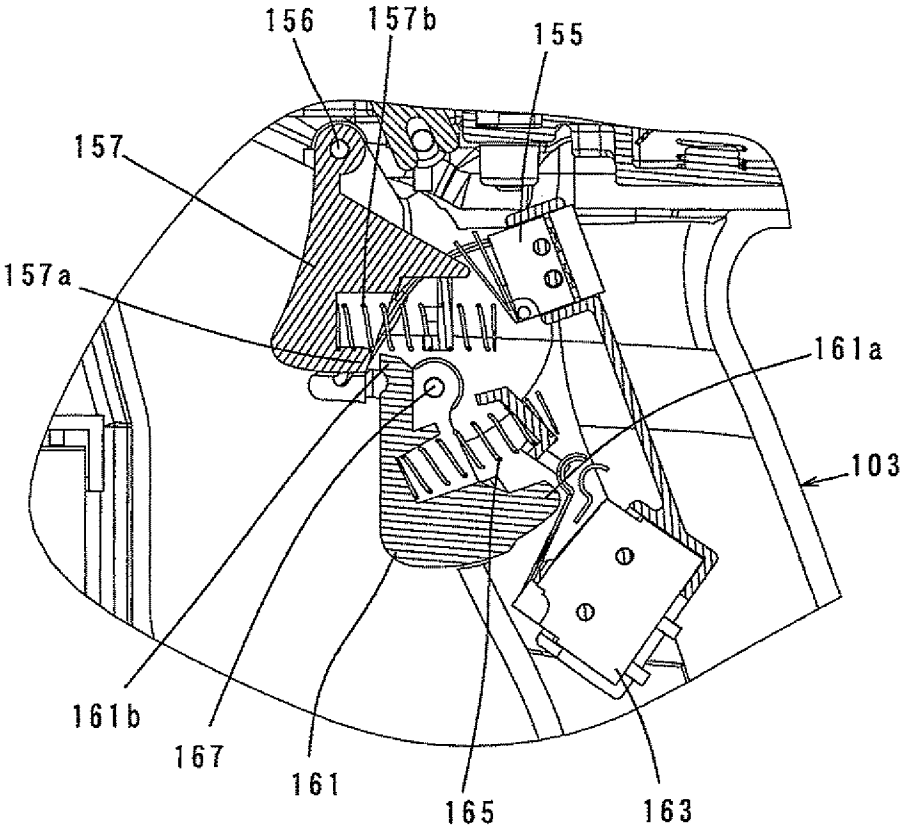
FIG. 5 is a partly enlarged sectional view of FIG. 1, showing a trigger and a trigger lock lever which are disposed in a handle.

FIG. 5 is a partly enlarged view of FIG. 1, showing the structure of the handle 103. The handle 103 is configured as a hollow member. The first electronic switch 163 disposed within the handle 103 is normally held in an off position by a built-in return spring (not shown). A trigger lock lever 161 is mounted to the handle 103 such that it can rotate around a pivot 167. When the user turns the trigger lock lever 161, an actuator of the first electronic switch 163 is pressed by an end actuating part 161*a* of the trigger lock lever 161, so that the first electronic switch 163 is turned on.

When the user releases the trigger lock lever 161, the trigger lock lever 161 is held in an initial position in which the first electronic switch 163 is turned off by the biasing force of a return spring 165. The trigger lock lever 161 has a locking part 161*b* for trigger locking on the side opposite from the end actuating part 161*a*. When the trigger lock lever 161 is placed in the initial position, the locking part 161*b* engages with an engagement part 157*a* of a trigger 157 for nail driving operation (for activating an electromagnetic solenoid 171 which is described below) from the rear, so that the operation of depressing the trigger 157 is prevented (locked). Specifically, the operation of depressing the trigger 157 is prevented unless the locking part 161*b* is released by user's operation of turning the trigger lock lever 161.

Figure 4:
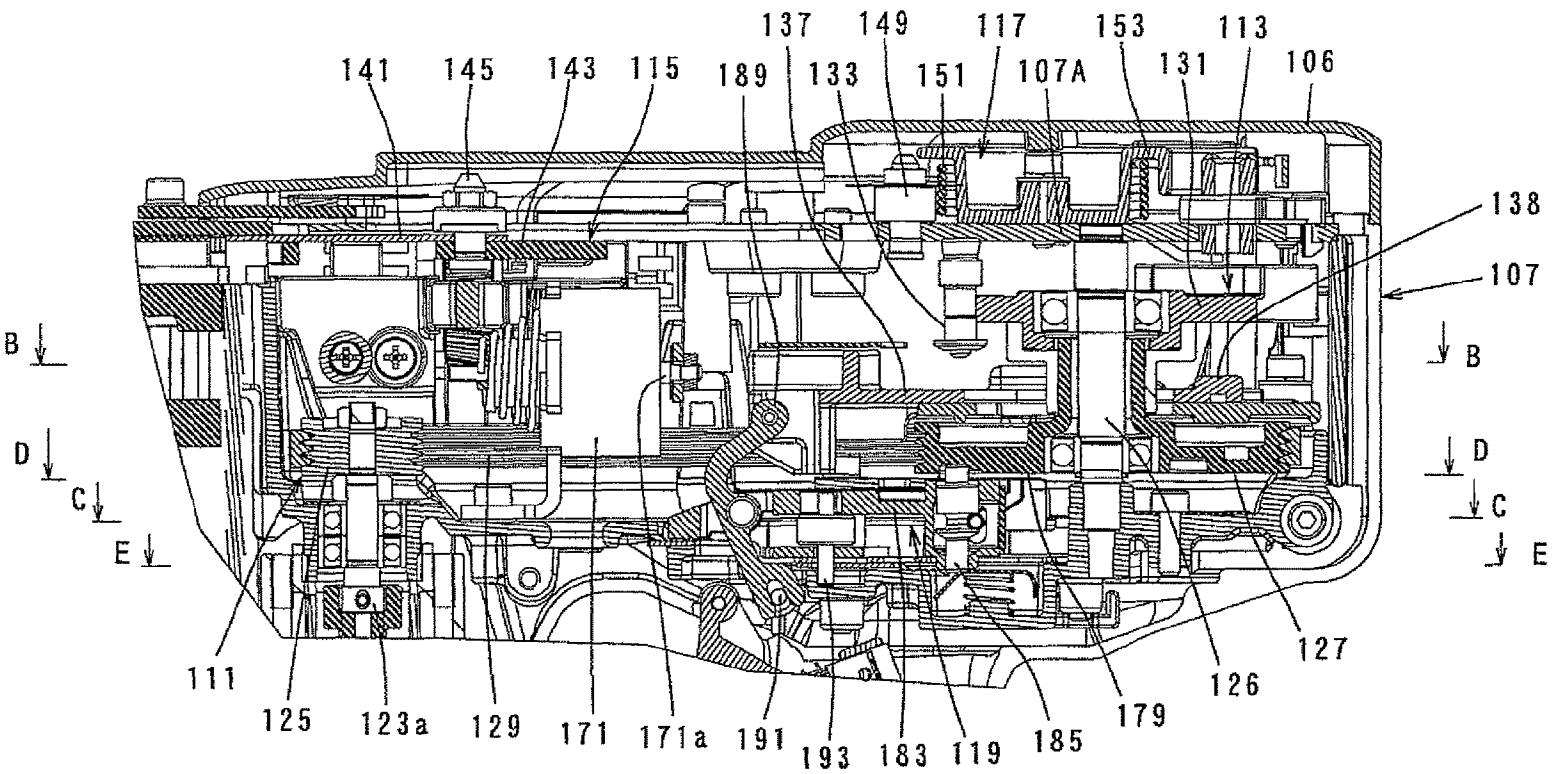
FIG. 4 is a sectional view of an essential part of the nailing machine, showing a power transmitting mechanism, a driver driving mechanism and a driver mechanism which are disposed in a body housing.

As shown in FIGS. 1 and 4, the body housing 107 is shaped like a box having an open front side and elongate in a longitudinal direction of a driver 141, and a cover plate 107A closes the front side opening. The cover plate 107A is detachably mounted to the body housing 107 by appropriate fastening means such as a set screw or a locking hook. As shown in FIG. 4, the body housing 107 houses a power transmitting mechanism 111 that transmits power of the driving motor 123, a driver driving mechanism 113 that is activated by power inputted from the power transmitting mechanism 111, a driver mechanism 115 that is driven by the driver driving mechanism 113 and serves to drive a nail (material to be driven) into a workpiece, and a driver return mechanism 117 that returns the driver mechanism 115 to a standby position (initial position) after completion of the driving movement.

The power transmitting mechanism 111 mainly includes a driving V-pulley 125 that is provided on an output shaft 123*a* which is driven by the driving motor 123, a driven V-pulley 127 that is rotatably provided on a support shaft 126, and a V-belt 129 that is looped over the V-pulleys 125, 127. The output shaft 123*a* and the support shaft 126 are disposed in parallel to each other and transversely to a nail driving direction or the longitudinal direction of the driver 141 (the longitudinal direction of the body 101). Further, the output shaft 123*a* and the support shaft 126 are arranged such that each of the directions of their axes is generally parallel to an extending direction of the magazine 105 and an extending direction of the handle 103.

Figure 12:
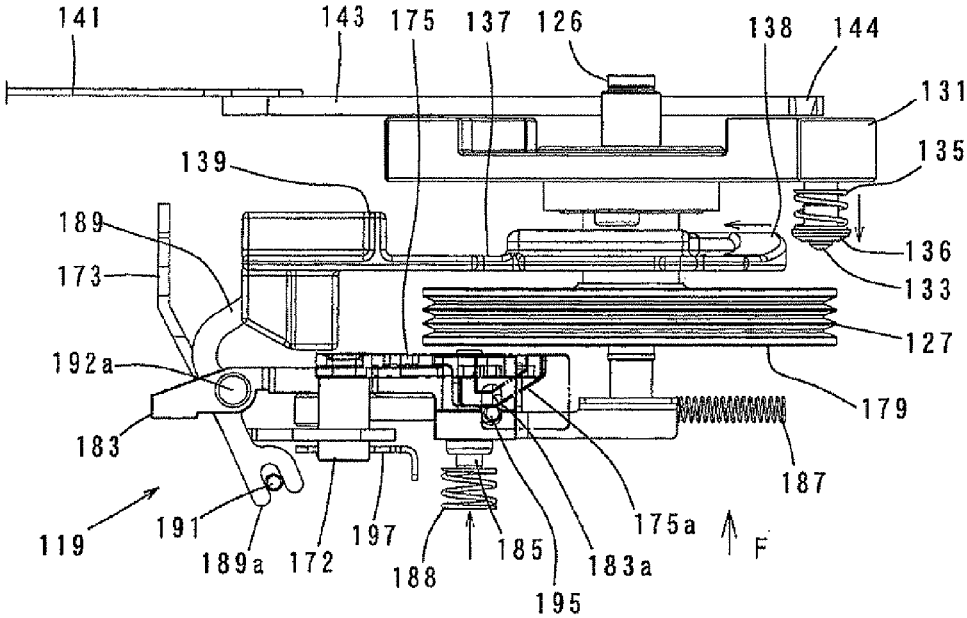
FIG. 12 is an external view showing the cam switching mechanism in the initial state.
Figure 15:
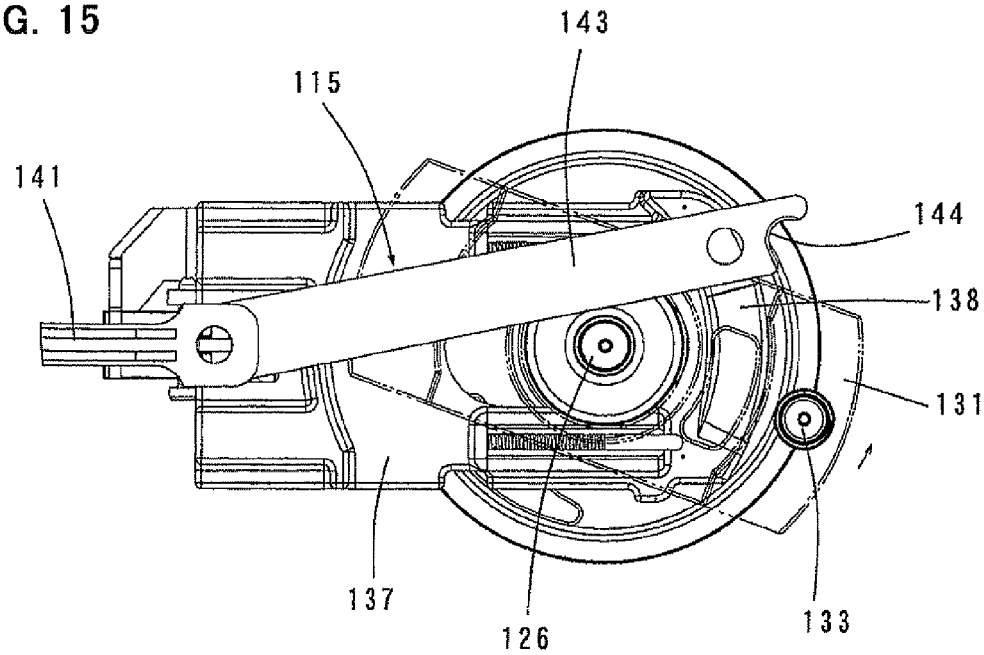
FIG. 15 shows the positional relationship between a cam plate and a driving pin in the initial state.
Figure 16:
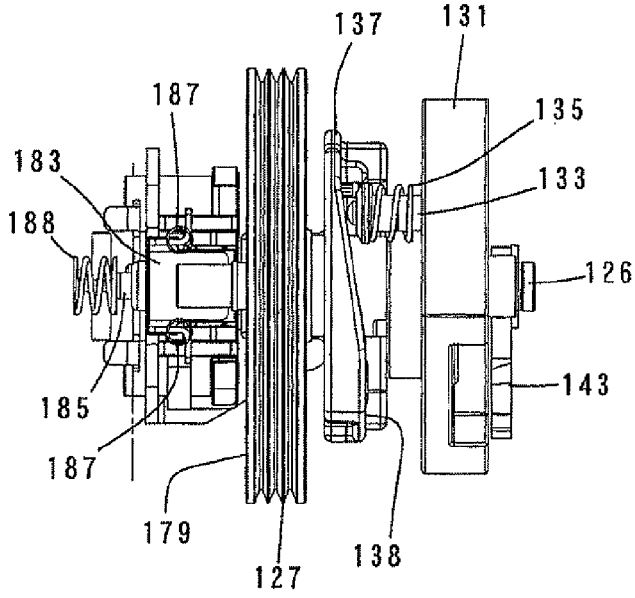
FIG. 16 shows the positional relation between the cam plate and the driving pin in the initial state, as viewed from the right in FIG. 15.
Figure 17:
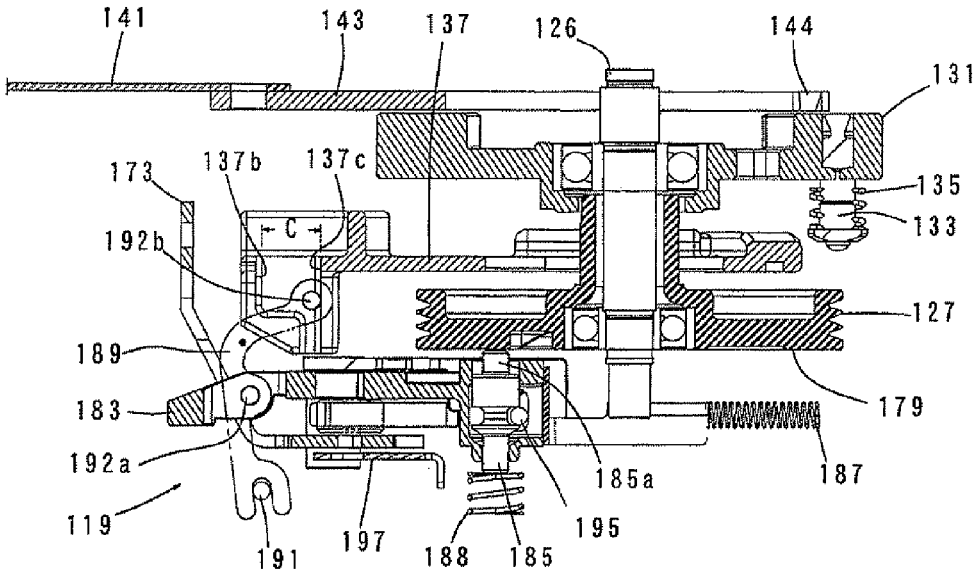
FIG. 17 is a sectional view showing the cam switching mechanism immediately after user's driving operation (switch-on).
Figure 18:
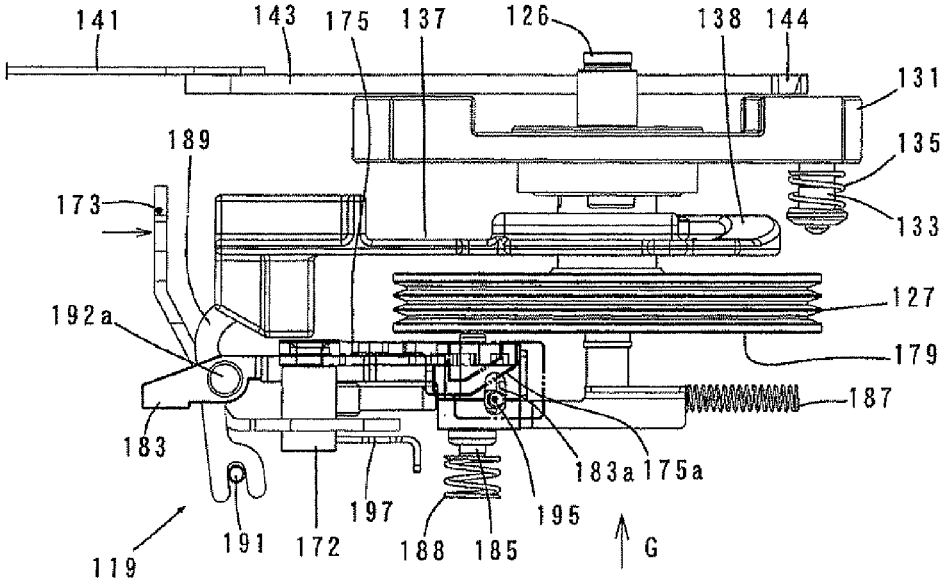
FIG. 18 is an external view showing the cam switching mechanism immediately after the user's driving operation.
Figure 19:
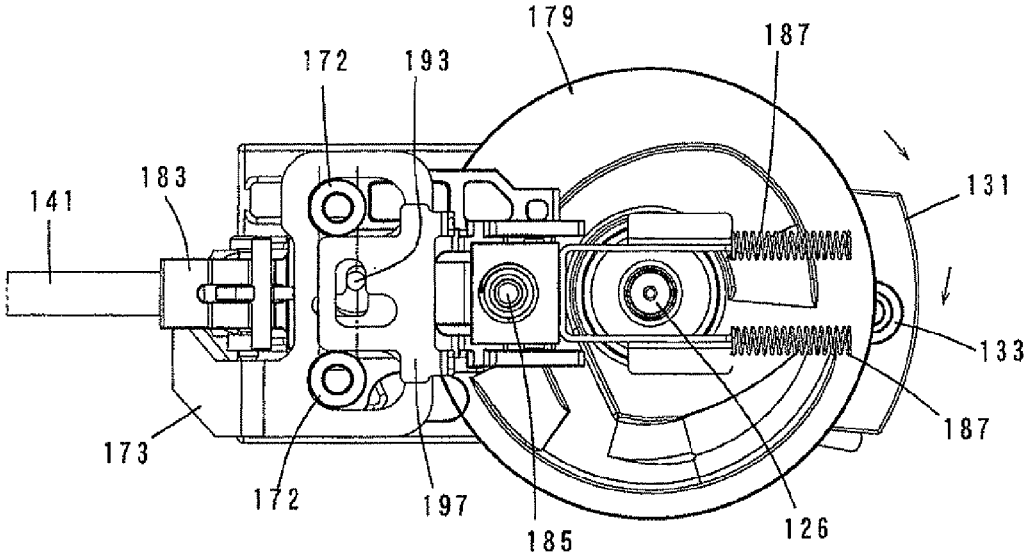
FIG. 19 is a view as viewed from the direction of the arrow G in FIG. 18 immediately after the user's driving operation.
Figure 20:
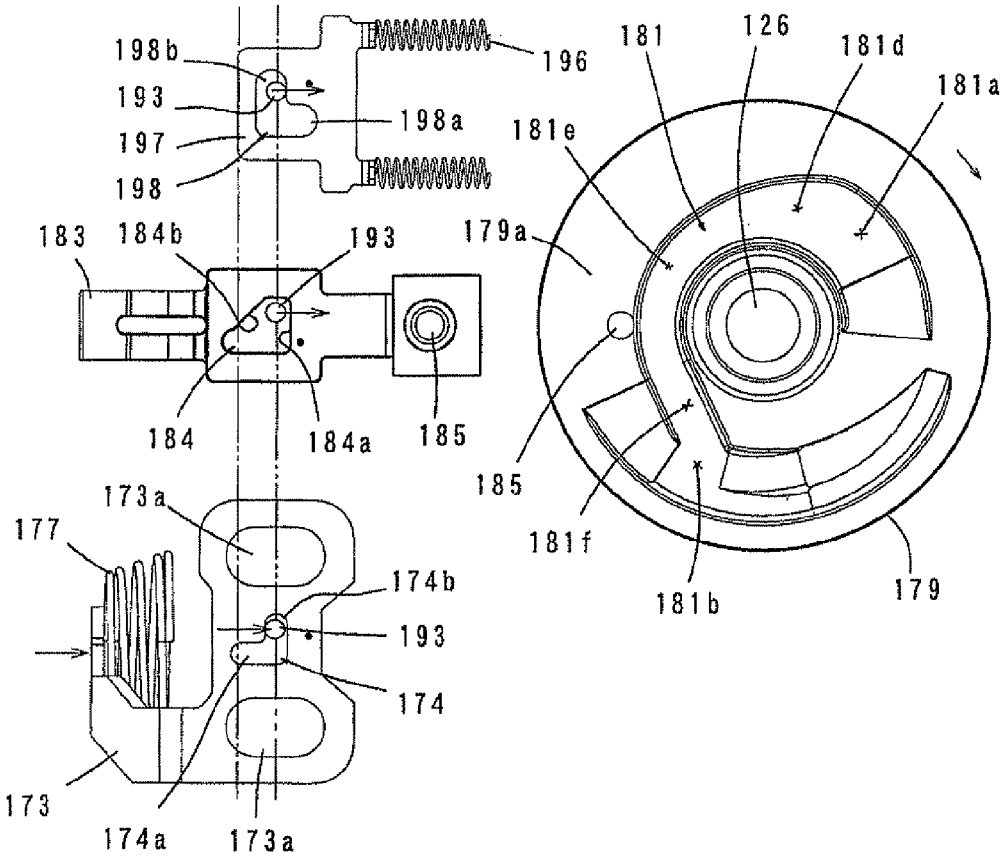
FIG. 20 shows the components of the cam switching mechanism shown disassembled immediately after the user's driving operation.
Figure 21:
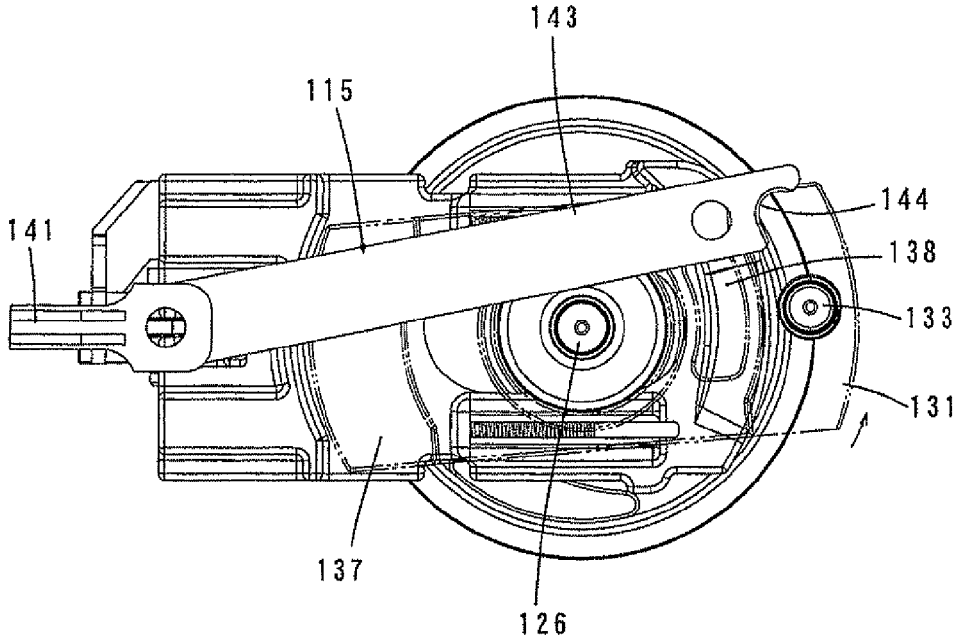
FIG. 21 shows the positional relation between the cam plate and the driving pin immediately after the user's driving operation.
Figure 22:
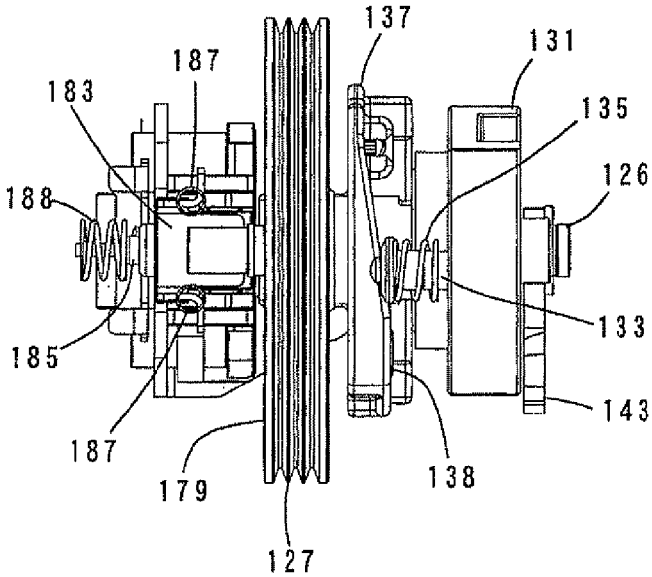
FIG. 22 shows the positional relation between the cam plate and the driving pin immediately after the user's driving operation, as viewed from the right in FIG. 21.
Figure 23:
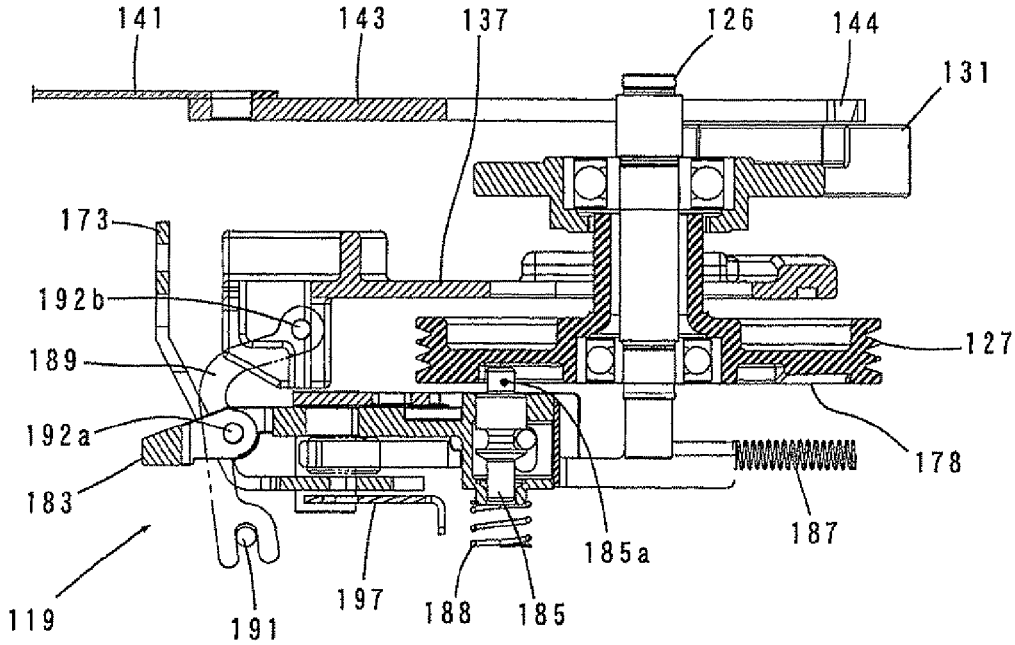
FIG. 23 is a sectional view showing the cam switching mechanism when a flat cam and a switch block are connected to each other.
Figure 24:
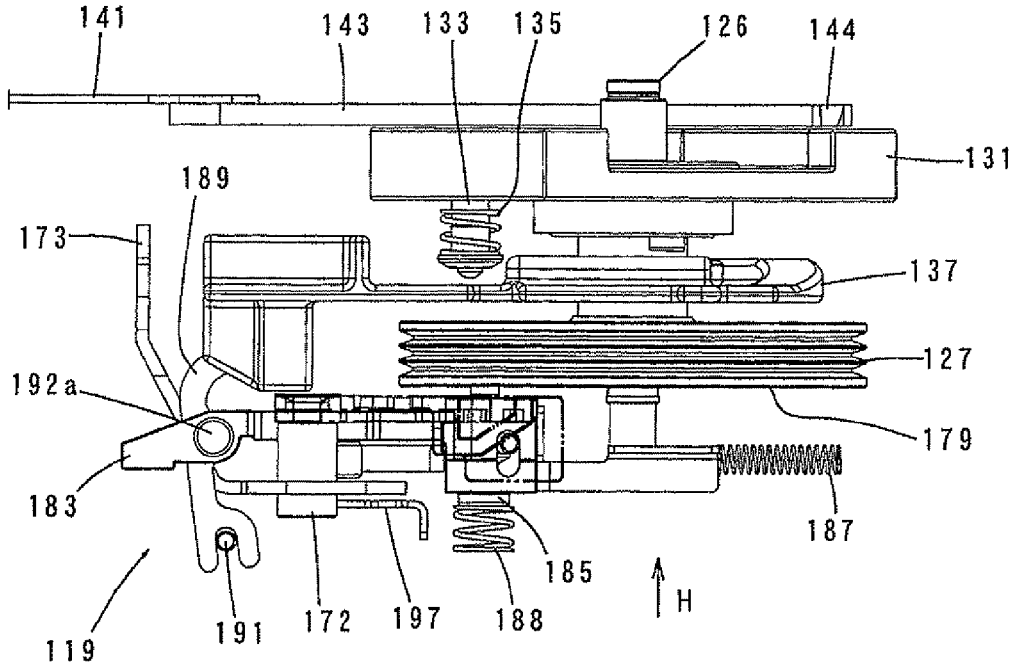
FIG. 24 is an external view showing the cam switching mechanism when the flat cam and the switch block are connected to each other.
Figure 25:
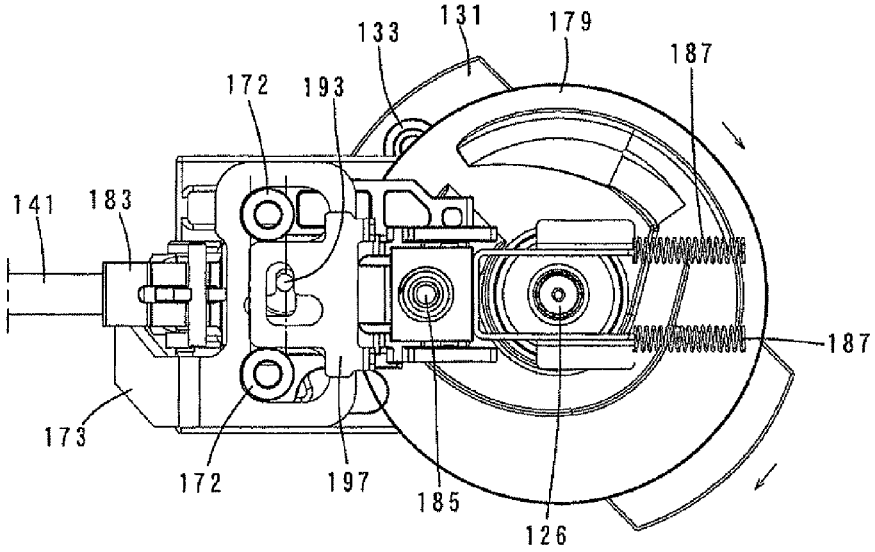
FIG. 25 is a view as viewed from the direction of the arrow H in FIG. 24 when the flat cam and the switch block are connected to each other.

The driver driving mechanism 113 is shown in FIGS. 12, 15 and 16. The driver driving mechanism 113 mainly includes a flywheel 131 that is configured as a generally rectangular (or disk-like) mass element which has a predetermined mass in order to obtain kinetic energy required for driving nails, a driving pin 133 that is mounted to the flywheel 131 and can move (back and forth) in a direction of a rotational axis of the flywheel 131, and a cam plate 137 that protrudes the driving pin 133 from one side of the flywheel 131. The flywheel 131 and the driving pin 133 are features that correspond to the "rotational member" and the "driving member for the driving mechanism", respectively, according to this invention. The flywheel 133 is rotatably mounted onto the support shaft 126 and rotationally driven together with the driven V-pulley 127. Therefore, in the state in which the driving motor 123 is driven, the flywheel 131 is constantly rotated via the power transmitting mechanism 111.

The driving pin 133 is disposed in an eccentric position displaced a predetermined distance from the center of rotation of the flywheel 131 (see FIG. 15). Therefore, when the flywheel 131 rotates, the driving pin 133 is caused to revolve around the rotational axis of the flywheel 131. The driving pin 133 has such a longitudinal length that it can extend through a through hole 131*a* (see FIG. 53) formed in the flywheel 131. Further, the driving pin 133 is mounted in the through hole 131*a* such that it can move in the direction of the rotational axis of the flywheel 131. The driving pin 133 moves between a protruded position in which one axial end of the driving pin 133 protrudes from one side of the flywheel 131 and a retracted position in which it retracts from the protruded position. The protruded position and the retracted position are features that correspond to the "first position" and the "second position", respectively, according to this invention. Further, a biasing force of a coil spring 135 is applied to the driving pin 133 such that the driving pin 133 is held in the retracted position. The coil spring 135 is disposed between a spring receiver 136 (see FIG. 12) provided on the other end of the driving pin 133 and the other side of the flywheel 131. With such a construction, the driving pin 133 is normally held in a retracted position in which it does not protrude from the one side of the flywheel 131 (actually a retracted position in which it is substantially flush with the side of the flywheel 131). The coil spring 135 is a feature that corresponds to the "biasing member" according to this invention. In the following description, for the sake of convenience of explanation, one side of the flywheel 131 is taken as the front side and the other side as the back side.

Figure 11:
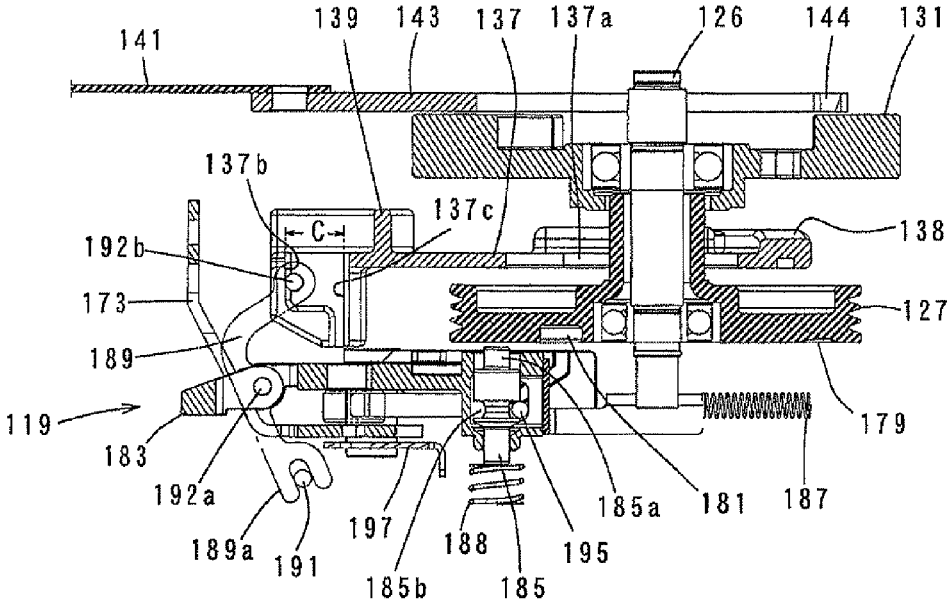
FIG. 11 is a sectional view showing a cam switching mechanism in an initial state.

The cam plate 137 has a generally rectangular plate-like shape and is disposed between the flywheel 131 and the driven V-pulley 127 such that it is opposed to the back side of the flywheel 131 (see FIGS. 4, 11 and 12). The cam plate 137 can linearly move in a back-and-forth direction transverse to the rotational axis of the flywheel 131, or the longitudinal direction of the driver 141 and the body 101.

A sloped cam face 138 is formed on a rear end region (on the side opposite to the driver 141) of the side of the cam plate 137 which faces the flywheel 131. The cam face 138 extends in the direction of rotation of the driving pin 133 which rotates together with the flywheel 131, and protrudes from the side of the cam plate 137. When the cam plate 137 is moved rearward, the cam face 138 is placed in a position displaced from a rotation path of the driving pin 133. Further, when the cam plate 137 is moved forward, the cam face 138 is placed in a position in which it is opposed to the rotation path (revolution path) of the driving pin 133, or in which it can engage with (come in contact with) the other end of the driving pin 133. The cam face 138, the position in which the cam face 138 is placed in a position displaced from the revolution path of the driving pin 133, and the position in which the cam face 138 is placed on the revolution path of the driving pin 133 are features that correspond to the "cam member", the "inoperative position" and the "operative position", respectively, according to this invention.

The cam plate 137 is caused to travel once between the rearward position or inoperative position and the forward position or operative position by a cam switching mechanism 119 which is described below, while the flywheel 131 rotates one turn (while the driving pin 133 revolves one turn around the rotational axis of the flywheel 131). The width of the cam face 138 of the cam plate 137 (the length in the direction of movement of the cam plate 137) is designed, for example, such that the cam face 138 is placed on the revolution path of the driving pin 133 in most of the range of one travel of the cam plate 137 in which it is moved from the inoperative position to the operative position and then returned to the inoperative position again.

Figure 29:
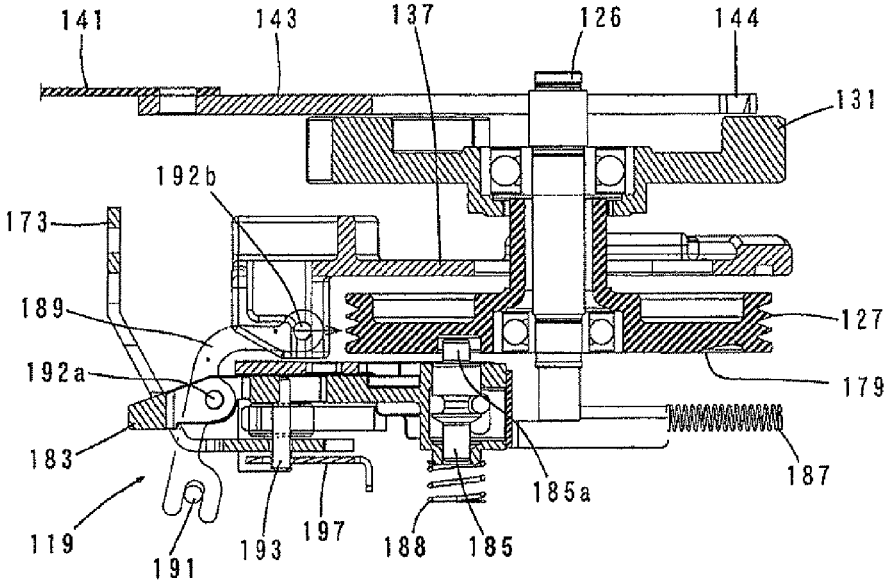
FIG. 29 is a sectional view showing the cam switching mechanism when the cam plate is moved to an operative position.
Figure 30:
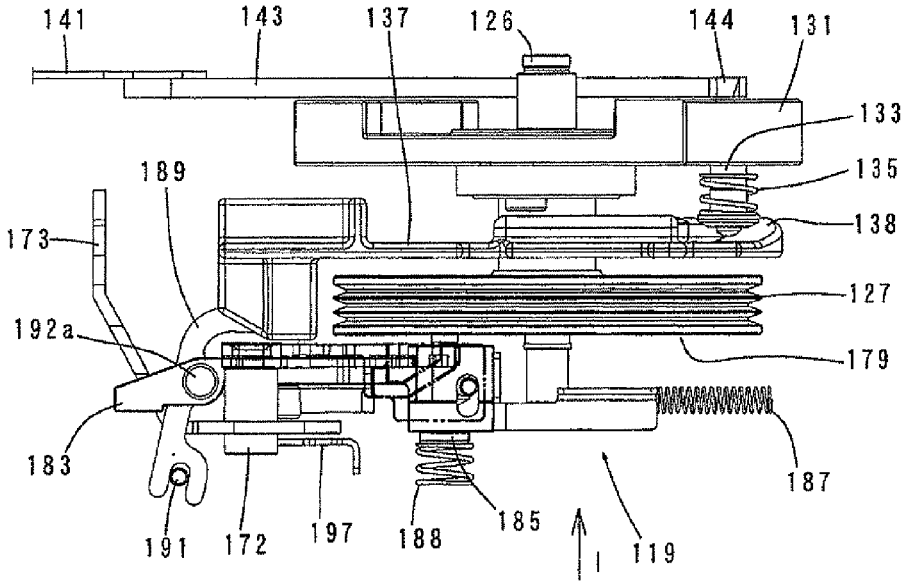
FIG. 30 is an external view showing the cam switching mechanism when the cam plate is moved to the operative position.
Figure 33:
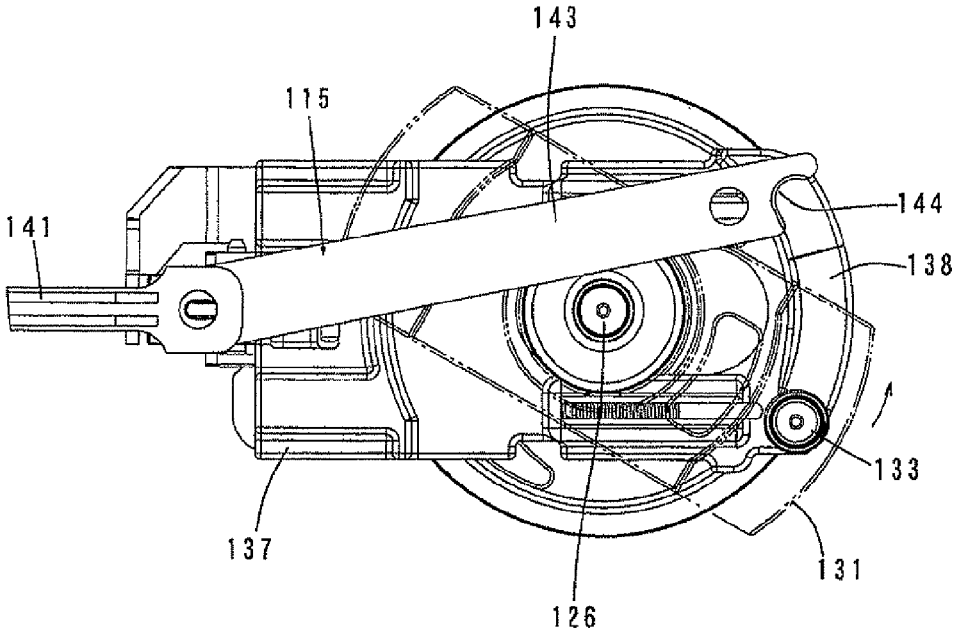
FIG. 33 shows the positional relation between the cam plate and the driving pin when the cam plate is moved to the operative position.
Figure 34:
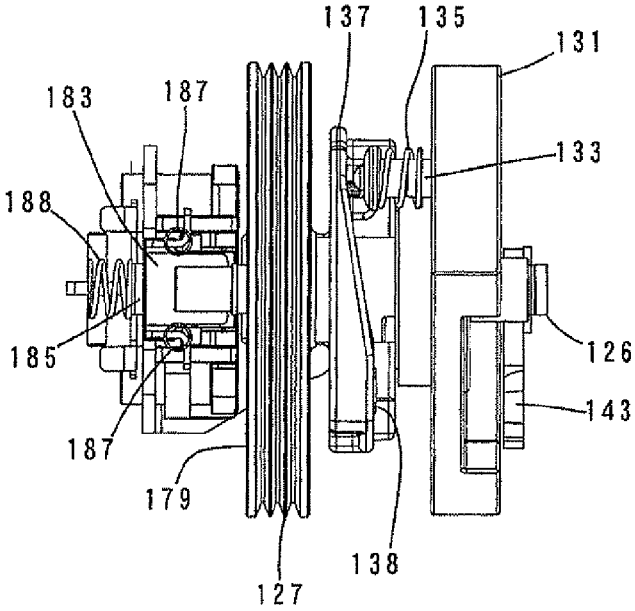
FIG. 34 shows the positional relation between the cam plate and the driving pin when the cam plate is moved to the operative position, as viewed from the right in FIG. 33.

The cam plate 137 is biased by the coil spring 132 (see FIG. 7) such that it is normally placed in the position in which the driving pin 133 does not protrude or the inoperative position (as shown in FIGS. 11, 12 and 15). Further, the cam plate 137 is moved to the position in which the driving pin 133 protrudes or the operative position (as shown in FIGS. 29, 30 and 33), by user's request for nail driving or by user's nail driving operation. Specifically, the second electronic switch 155 (see FIG. 5) is turned on by depressing the trigger 157 on the handle 103, and the third electronic switch (not shown) is turned on when a front end of a contact arm disposed on a front end of the driver guide 121 is pressed against a workpiece and retracted. At this time, the cam switching mechanism 119 is driven and then drives the cam plate 137, and the cam plate 137 is caused to travel once between the inoperative position and the operative position during one turn of the flywheel 131, which will be described below. The user's nail driving operation here refers to user's operation in which the second electronic switch 155 is turned on by depressing the trigger 157 and the third electronic switch is turned on by pressing the contact arm against a workpiece. The coil spring 132 is a feature that corresponds to the "spring member for forcible return" according to this invention.

Figure 41:
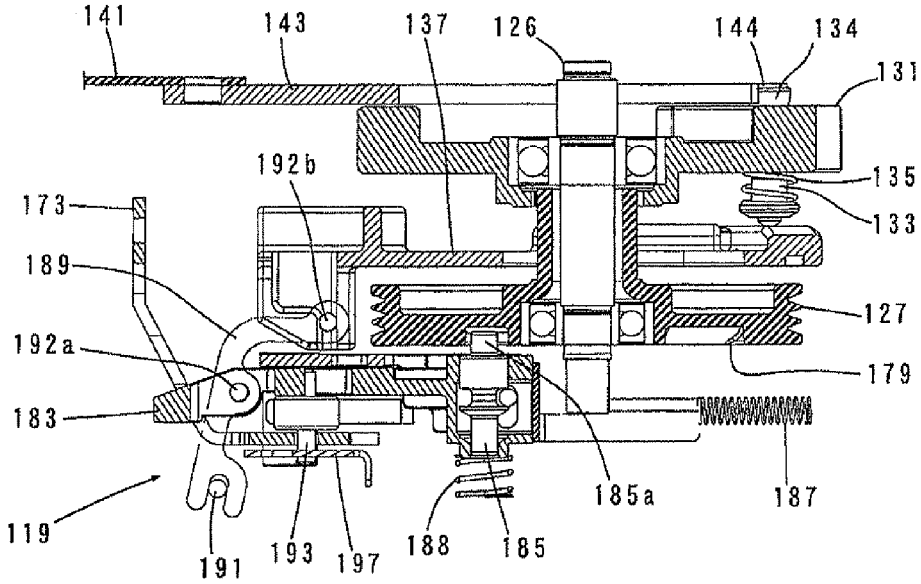
FIG. 41 is a sectional view showing the cam switching mechanism at the start of driving movement.
Figure 42:
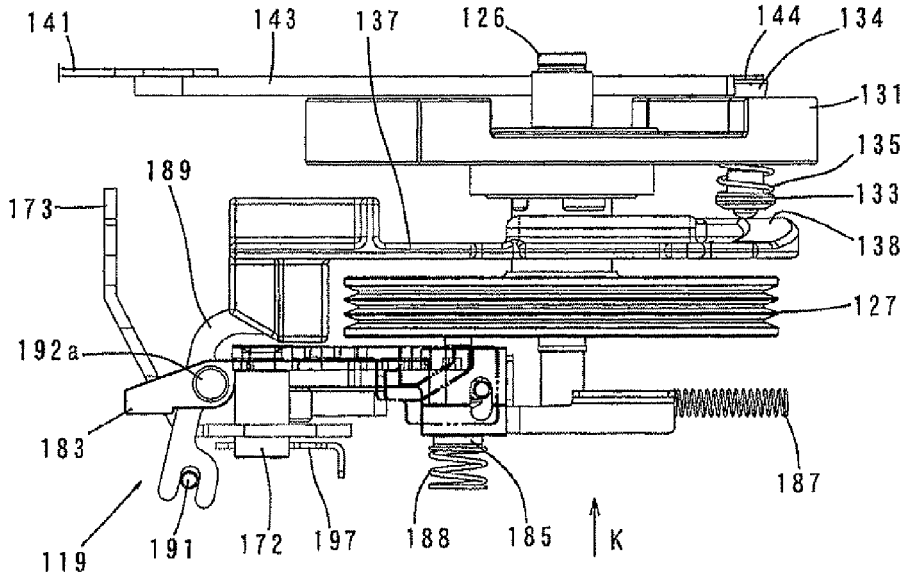
FIG. 42 is an external view showing the cam switching mechanism at the start of driving movement.
Figure 43:
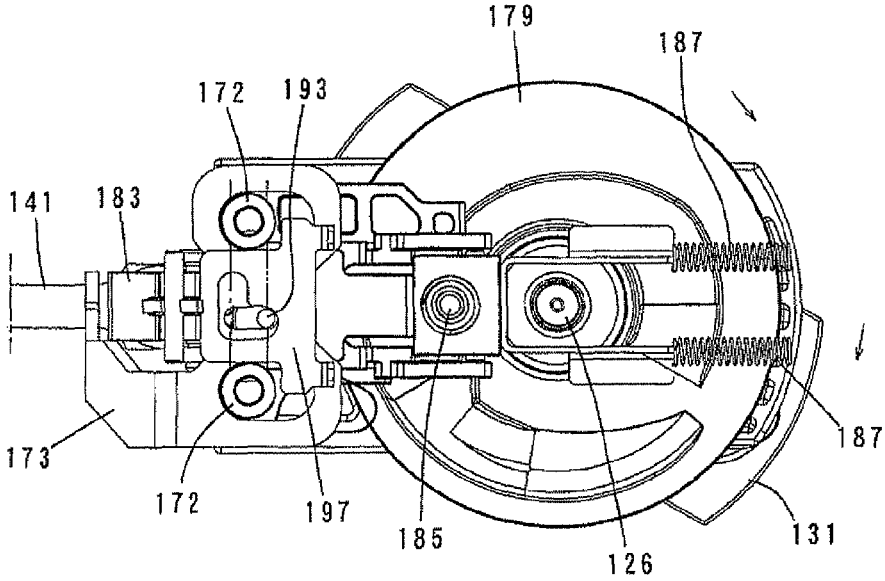
FIG. 43 is a view as viewed from the direction of the arrow K in FIG. 42 at the start of driving movement.
Figure 44:
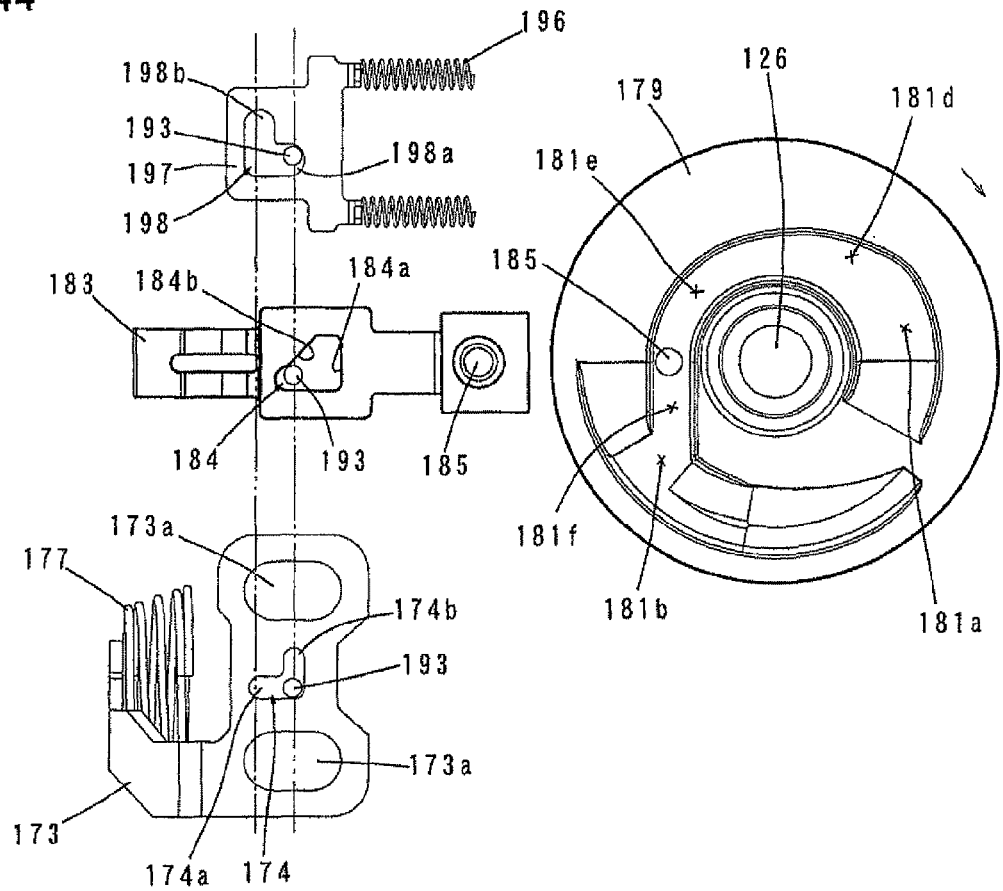
FIG. 44 shows the components of the cam switching mechanism shown disassembled at the start of driving movement.
Figure 45:
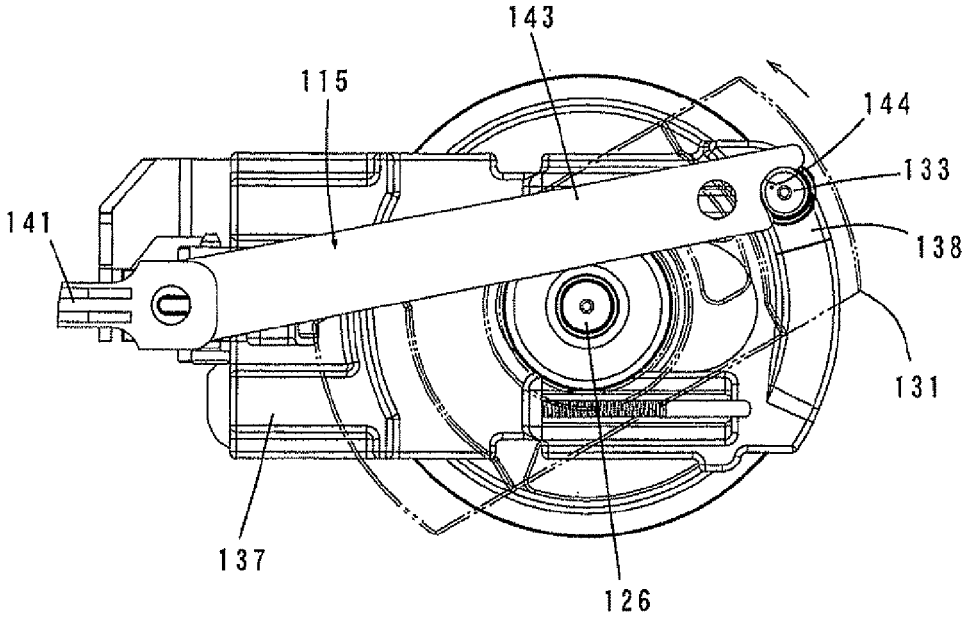
FIG. 45 shows the positional relation between the cam plate and the driving pin at the start of driving movement.

In the case in which the cam face 138 is placed in the operative position in which it faces the revolution path of the driving pin 133, when the driving pin 133 moves across the cam plate 137, the other end (on the back side of the flywheel 131) of the driving pin 133 climbs onto the cam face 138 and one end (on the front side of the flywheel 131) of the driving pin 133 relatively protrudes from the front side of the flywheel 131 (see FIG. 41). The one end of the driving pin 133 protruding from the front side of the flywheel 131 is defined as an engagement protrusion 134 which engages with the driver mechanism 115 which is described below. The length of the cam face 138 or length (slope length) in a direction transverse to the direction of movement of the cam plate 137 is designed such that it extends over a predetermined angular range, or about 40 degrees in this embodiment, within a rotational region (360 degrees) of the driving pin 133. Therefore, in the 40-degree region in which the driving pin 133 moves on the cam face 138, the engagement protrusion 134 protrudes from the front side of the flywheel 131, but in the other region, the engagement protrusion 134 does not protrude or is returned to the retracted position by the coil spring 135.

Figure 7:
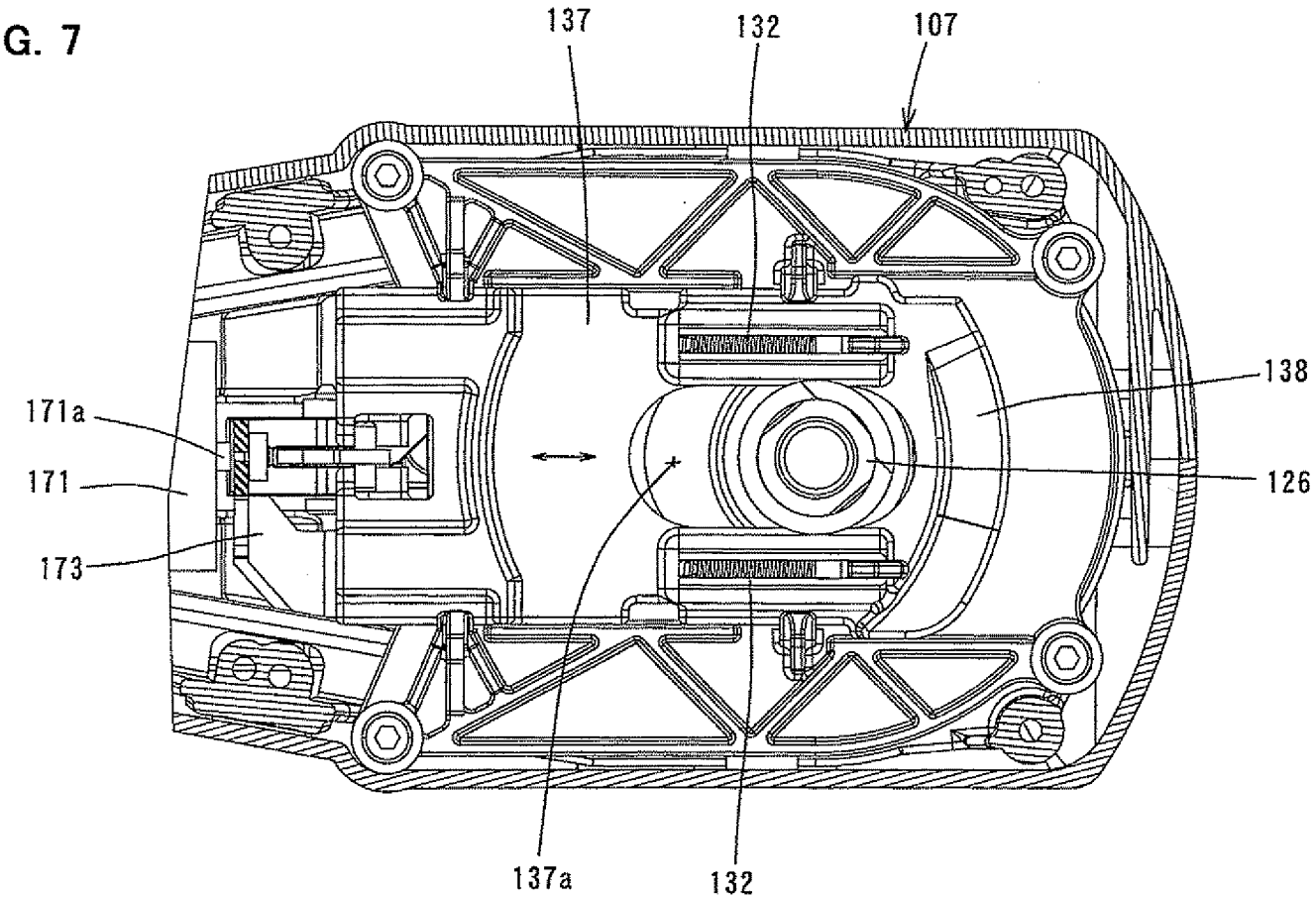
FIG. 7 is a sectional view taken along line B-B in FIG. 4.

An escape hole 137*a* having an elliptical shape long in the direction of movement of the cam plate 137 is formed in the center of the cam plate 137 in order to avoid the cam plate 137 from interfering with the support shaft 126 extending through the cam plate 137 (see FIG. 7).

Figure 6:
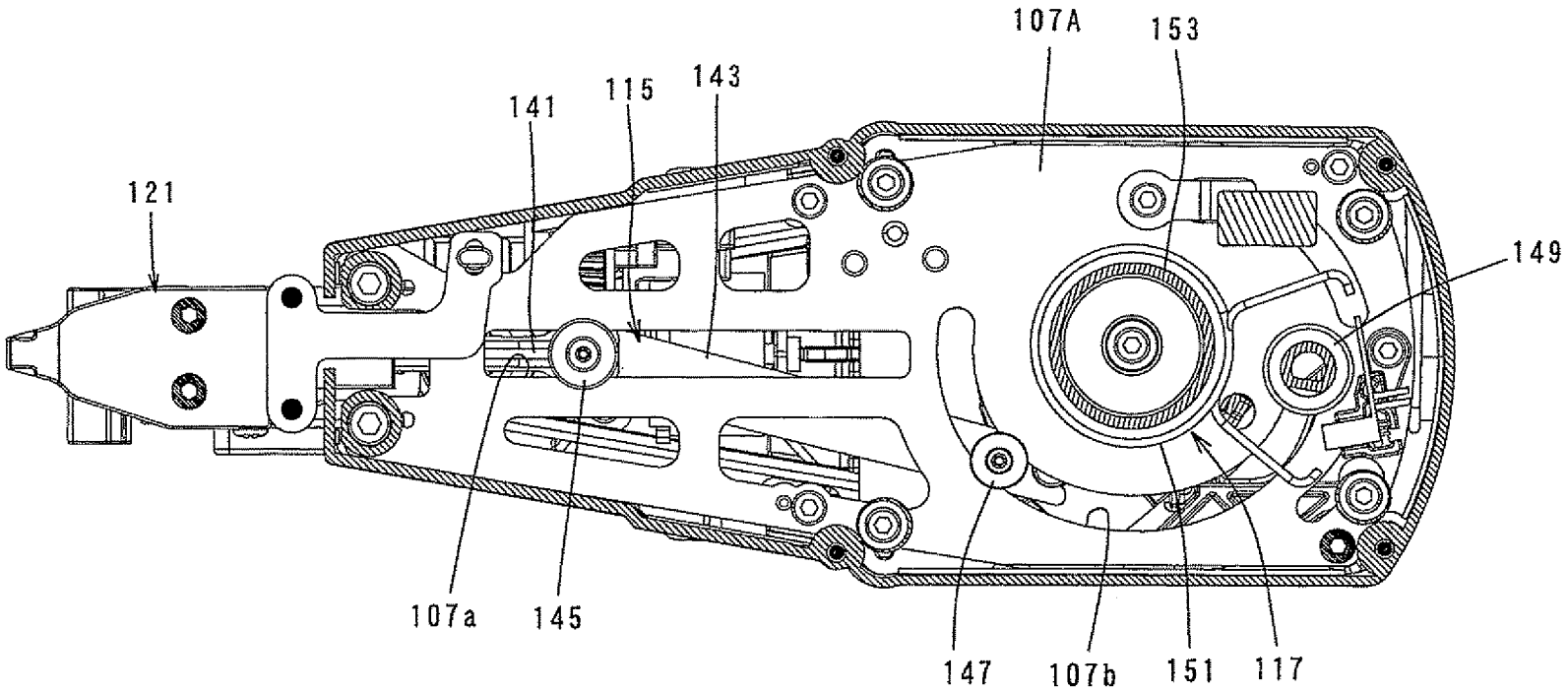
FIG. 6 is a sectional view taken along line A-A in FIG. 1.

The driver mechanism 115 is now explained. The structure of the driver mechanism 115 is shown in FIGS. 6, 11 and 15. The driver mechanism 115 is a feature that corresponds to the "driving mechanism" according to this invention. The driver mechanism 115 mainly includes a driver 141 and a link arm 143. The driver 141 comprises an elongate rod-like member and serves as an actuating member for driving a nail by linearly moving in the longitudinal direction of the body 101 and moving forward within a driving hole 121*a* of the driver guide 121. The link arm 143 is a motion converting member which converts revolution of the driving pin 133 into linear motion and drives the driver 141. One end of the link arm 143 is connected to one end (rear end) of the driver 141 in its longitudinal direction by a connecting pin 145 such that it can rotate with respect to the driver 141. Further, the link arm 143 extends obliquely rearward and the extending end of the link arm 143 has an engagement recess 144 with which the engagement protrusion 134 of the driving pin 133 protruding from the front side of the flywheel 131 can engage. The engagement recess 144 is generally C-shaped and has an opening which allows the engagement protrusion 134 of the driving pin 133 to be inserted and engaged in the engagement recess 144 by movement of the driving pin 133 in the radial direction.

As shown in FIG. 6, the driver 141 and the link arm 143 are disposed inside the cover plate 107A which closes the front opening of the body housing 107. The linear movement of the driver 141 is defined by movement of the tip end (front end) of the driver 141 within the driving hole 121*a* of the driver guide 121 and by movement of the connecting pin 145 for connecting the driver 141 and the link arm 143 along a linear guide hole 107*a* which is formed in the cover plate 107A and extends in the longitudinal direction. Further, a guide member in the form of a guide pin 147 which extends in a direction transverse to the extending direction of the link arm 143 is provided on the extending end region of the link arm 143. The guide pin 147 moves along a generally semi-circular arc guide hole 107*b* formed in the cover plate 107A.

The driver 141 and the link arm 143 are normally held in the standby position by the driver return mechanism 117 which is described below. The standby position represents a position in which the driver 141 is returned to the rear (right as viewed in FIGS. 1 and 4) position as far away from the driver guide 121 as possible and the guide pin 147 protruding to an outer surface through the guide hole 107*b* of the cover plate 107A is held in contact with a stopper pin 149 mounted on the outside of the cover plate 107A (see FIG. 6). In this standby position, the front end of the driver 141 is placed in the rear end (the right end as viewed in FIG. 6) of the driving hole 121*a* of the driver guide 121 and the C-shaped engagement recess 144 of the link arm 143 is placed in a position to allow engagement with the engagement protrusion 134 of the driving pin 133.

The C-shaped engagement recess 144 of the link arm 143 placed in the standby position can engage with the engagement protrusion 134 of the driving pin 133 when the engagement protrusion 134 is protruded from the front side of the flywheel 131 by the cam plate 137. The engagement of the engagement protrusion 134 with the C-shaped engagement recess 144 is made before the driving pin 133 passes through the cam face 138 of the cam plate 137. Further, this engaged state is kept until the driving pin 133 revolves substantially a half turn around the rotational axis of the flywheel 131, so that the driver 141 is caused to move forward via the link arm 143 and thus performs a nail driving movement.

Upon completion of the nail driving movement of the driver 141, the driving pin 133 is disengaged from the C-shaped engagement recess 144. Specifically, when the driver 141 is moved to a driving end, the engagement protrusion 134 of the driving pin 133 is radially moved out of the opening of the C-shaped engagement recess 144. The instant when the engagement protrusion 134 is disengaged from the C-shaped engagement recess 144, the driving pin 133 is returned to the initial retracted position by the coil spring 135.

The driver 141 is returned to the standby position by the driver return mechanism 117 after completion of the nail driving movement. The driver return mechanism 117 mainly includes a wheel 153 disposed on the outer surface of the cover plate 107A of the body housing 107 and a coil spring 151 wound on the wheel 153, but this construction is not directly related to the invention and therefore it is not described in further details. Further, a front cover 106 covers the cover plate 107A in its entirety, including the driver return mechanism 117 disposed on the outer surface of the cover plate 107A.

The cam switching mechanism 119 which serves to switch the cam plate 137 between the inoperative position and the operative position is now explained mainly with reference to FIGS. 11 to 14. The cam switching mechanism 119 mainly includes an electromagnetic solenoid 171, a switch plate 173, a flat cam 179, a switch block 183 and a link 189. The electromagnetic solenoid 171 is energized by the user's nail driving operation. The switch plate 173 is driven by the electromagnetic solenoid 171. The flat earn 179 is configured as a rotating cam which has a cam groove 181 on its flat surface and serves to switch the cam plate, and is caused to rotate together with the flywheel 131. The switch block 183 is linearly moved by the switch plate 173 and has a cam follower 185 which can be connected to and disconnected from the flat cam 179. The link 189 is configured as a connecting member for connecting the switch block 183 to the above-described cam plate 137.

Each of the above-described components is now explained in detail. The electromagnetic solenoid 171 (see FIG. 4) is fixedly mounted to the body housing 107. The electromagnetic solenoid 171 is energized when the user performs a nail driving operation, or when the second electronic switch 155 is turned on by depressing the trigger 157 and the third electronic switch (not shown) is turned on by pressing the contact arm (not shown) against the workpiece. On the other hand, the electromagnetic solenoid 171 is de-energized when either one of the second electronic switch 155 and the third electronic switch is turned off.

As shown in FIG. 5, the trigger 157 is attached to the handle 103 such that it can rotate on a shaft 156 by user's depressing operation. When the depressed trigger 157 is released, the trigger 157 is returned to its initial position by the return spring 157*b*. When the trigger 157 is depressed, an actuator of the second electronic switch 155 is pressed, so that the second electronic switch 155 is turned on. When the depressed trigger 157 is released, the second electronic switch 155 is turned off by a built-in return spring (not shown). Further, as described above, the operation of depressing the trigger 157 is controlled by the trigger lock lever 161. Therefore, when the trigger lock lever 161 is released, the trigger 157 is allowed to be depressed.

The contact arm (not shown) is attached to the driver guide 121 such that it extends in parallel to the driver guide 121 and can move in the longitudinal direction of the driver guide 121. Further, the contact arm is biased by a biasing spring (not shown) such that its tip end protrudes from the front end of the driver guide 121. When the contact arm is placed in the protruded position, the third electronic switch is turned off. Further, when the tip end of the contact arm is pressed against the workpiece and the contact arm is moved to the body housing 107 side, the third electronic switch is turned on.

Figure 8:
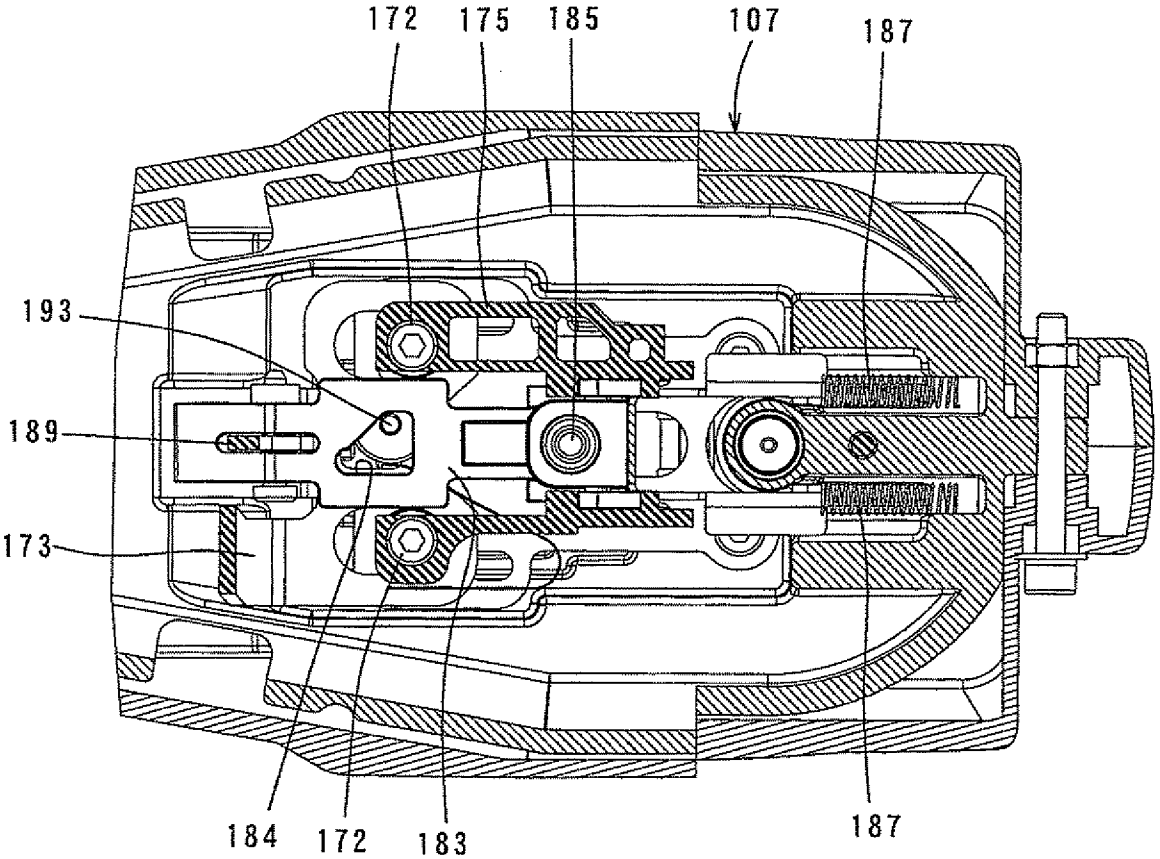
FIG. 8 is a sectional view taken along line C-C in FIG. 4.
Figure 9:
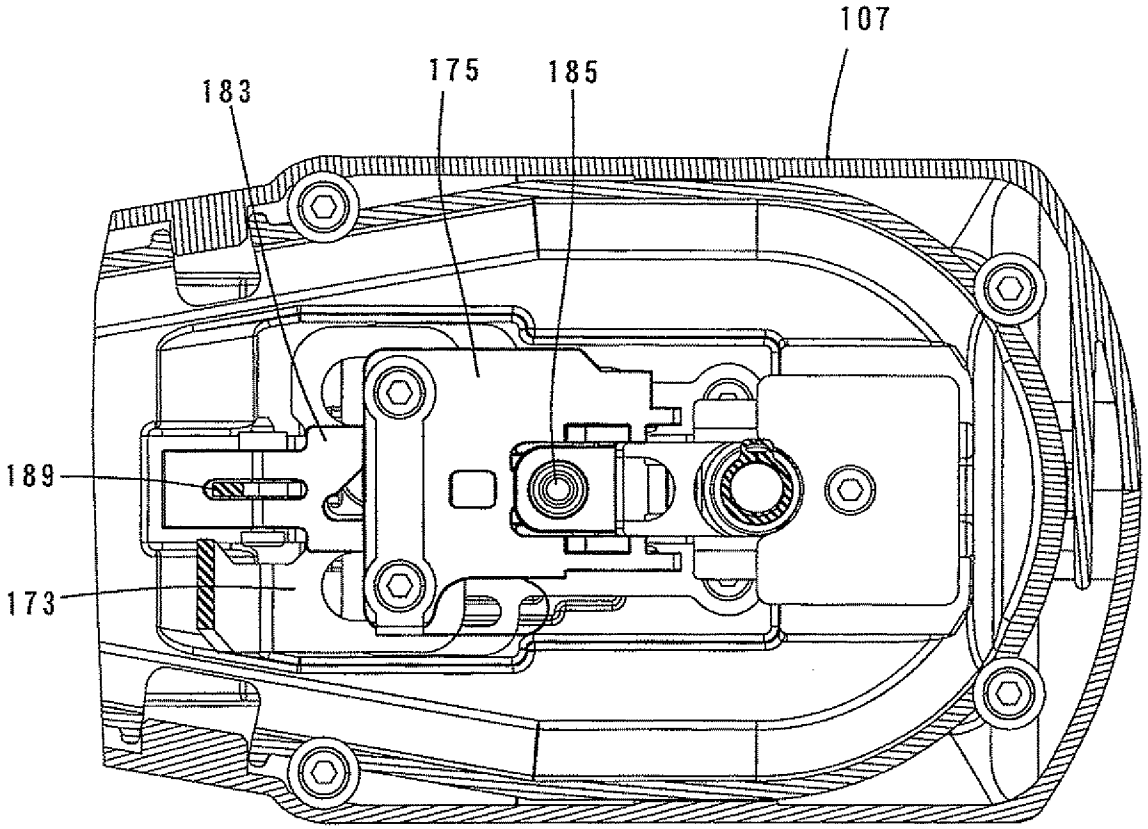
FIG. 9 is a sectional view taken along line D-D in FIG. 4.

The switch plate 173 has longitudinally extending slots 173*a* which are loosely fitted onto two columnar fixing pins 172 spaced a predetermined distance away from each other. The switch plate 173 is mounted such that it can linearly move in the extending direction of the slots 173*a* or the fore-and-aft direction via the two fixing pins 172 which serve as a guide member. The switch plate 173 is a feature that corresponds to the "movable member" according to this invention. Further, the two fixing pins 172 are disposed in parallel to each other and fixed to the body housing 107 via a mounting member 175 (see FIG. 8). One (front) end of the switch plate 173 is connected to a movable core 171*a* of the electromagnetic solenoid 171 (see FIGS. 4 and 7) and the other (rear) end is connected to a switch block 183 disposed on the front side of the switch plate 173 via a connecting pin 193. Therefore, when the user performs the nail driving operation and the electromagnetic solenoid is energized, the switch plate 173 is moved rearward (to the right as viewed in FIG. 11) by the movable core 171*a* of the electromagnetic solenoid 171 and moves the switch block 183 to a rear connection standby position (which will be described below) in which it can be connected to the flat cam 179. Further, the switch plate 173 is biased by a biasing member in the form of a spring 177 (see FIG. 14) in a direction opposite to the direction in which it is moved by the electromagnetic solenoid 171.

Figure 59:
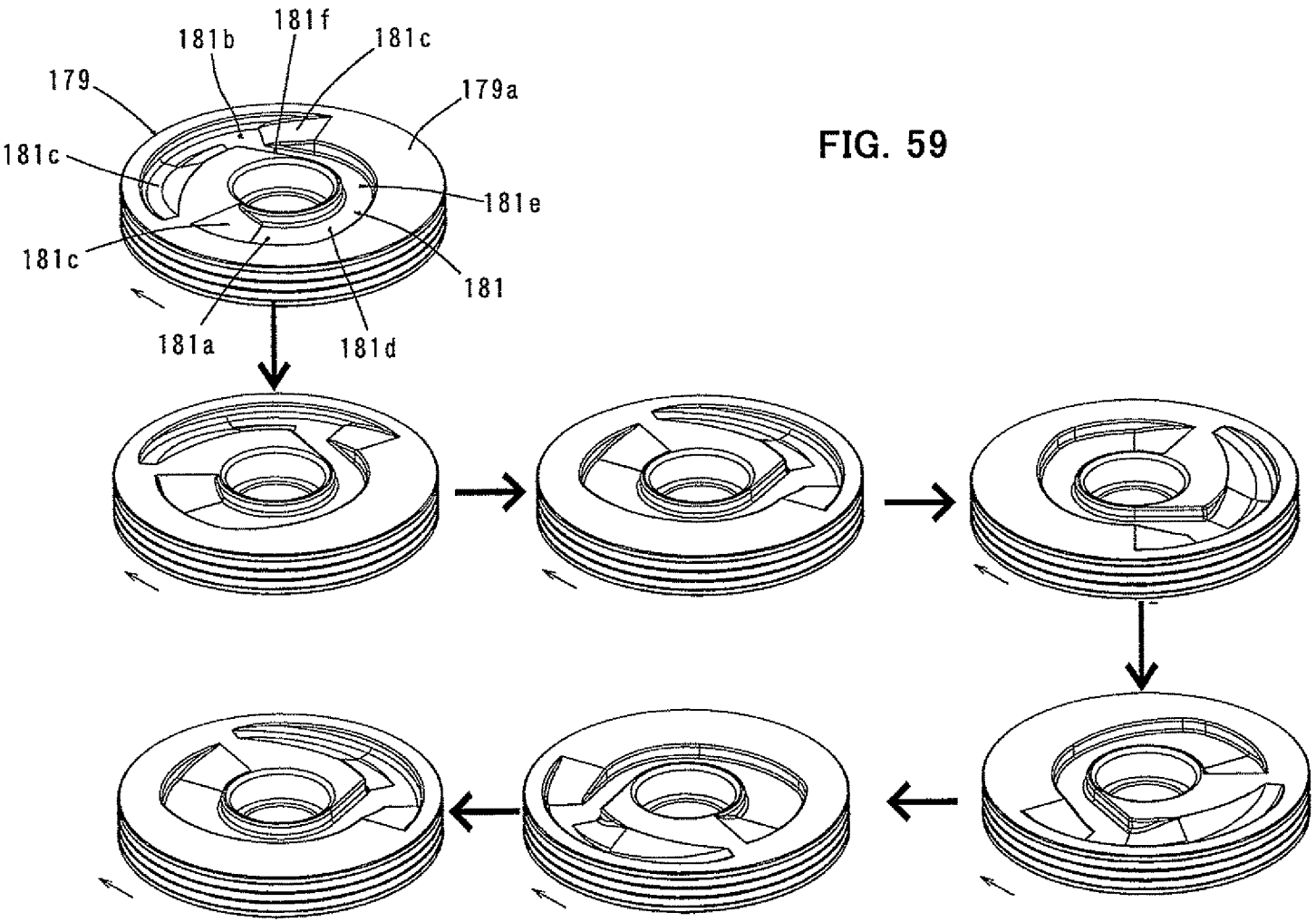
FIG. 59 shows an external view and movement of the flat cam.

The flat cam 179 is integrally formed with the back side of the driving V-pulley 127 (on the opposite side from the cam plate 137). FIG. 59 shows the outside shape of the flat cam 179 and sequentially illustrates the state in which the flat cam 179 is rotated in a direction of an arrow in the thawing (clockwise direction as viewed in the drawing). Specifically, the side (back side) of the driving V-pulley 127 has a disc-like shape having a flat region 179*a* in a radially outer region of its circular surface and having a concave cam groove 181 radially inside the flat region 179*a* (toward the center) and thus forms the flat cam 179. Therefore, the flat cam 179 is rotated together with the flywheel 131. The flat cam 179 is a feature that corresponds to the "rotationally driven element" according to this invention. The flat region 179*a* is formed over the entire radially outer region of the flat cam 179, and the cam groove 181 is formed inside the flat region 179*a* and extends in the circumferential direction over a predetermined circumferential range. The cam groove 181 is formed as a generally arcuate concave groove extending over the predetermined range in the circumferential direction of the flat cam 179. Further, a connecting recess (beginning of the groove) 181*a* is formed in one end of the cam groove 181 in the extending direction (the front end in the direction of rotation), and the cam follower 185 of the switch block 183 is connected to the connecting recess 181*a* when it enters the connecting recess 181*a*. A disconnecting recess (terminal end of the groove) 181*b* is formed in the other end of the cam groove 181 in the extending direction (the rear end in the direction of rotation), and the cam follower 185 is disconnected from the disconnecting recess 181*b* when it moves out of the disconnecting recess 181*b*.

Figure 10:
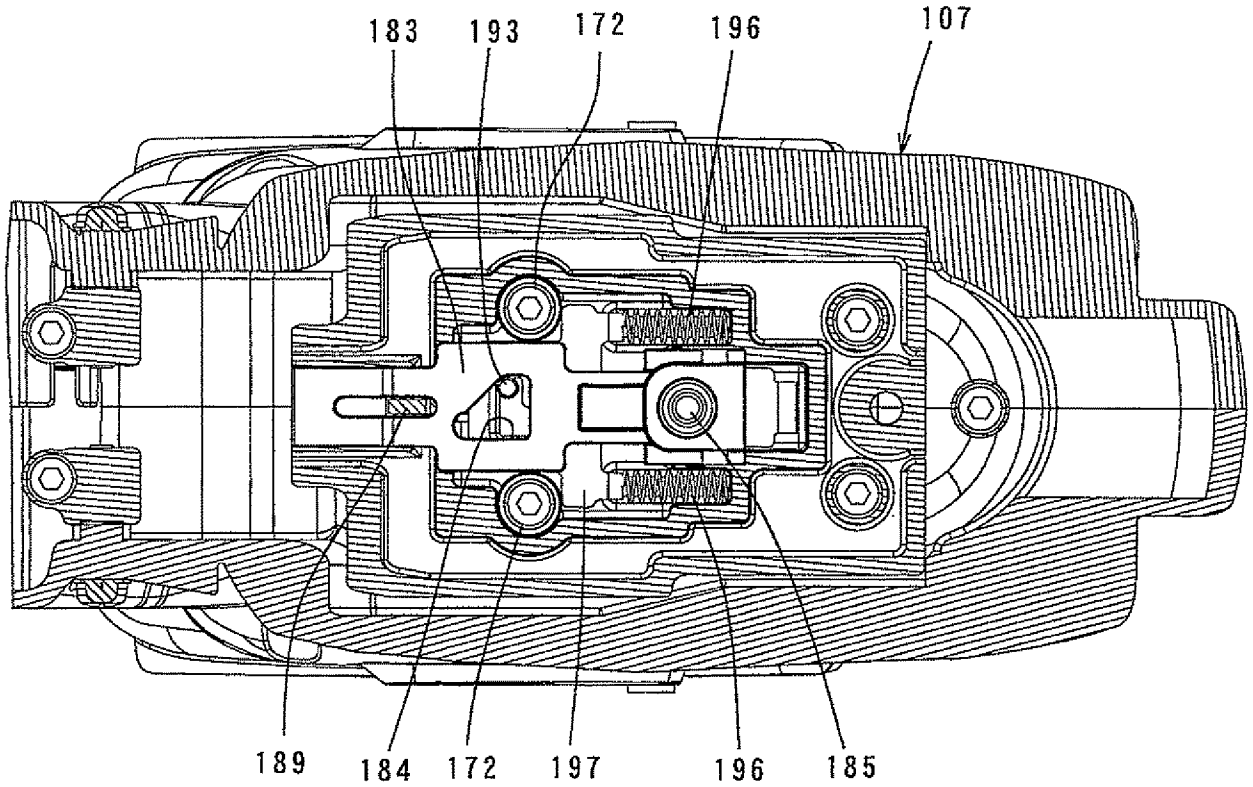
FIG. 10 is a sectional view taken along line E-E in FIG. 4.

The switch block 183 is a generally rectangular member extending in the longitudinal direction and disposed in parallel to the cam plate 137 and forward of the flat cam 179 on the side facing the flat cam 179 or on the opposite side of the flat cam 179 from the cam plate 137. The switch block 183 is a feature that corresponds to the "cam switching member" according to this invention. The columnar cam follower 185 is provided on one (rear) end of the switch block 183 in the extending direction and can be connected to and disconnected from the cam groove 181 of the flat cam 179, and the other (front) end of the switch block 183 in the extending direction is connected to the cam plate 137 via the link 189 (see FIGS. 11 and 12). The switch block 183 can be linearly moved in its extending direction or in the longitudinal direction transverse to the rotational axis of the flat cam 179 (the direction of movement of the cam plate 137) and disposed between the above-described two fixing pins 172. Further, the switch block 183 is guided in the longitudinal direction by the guide member in the form of the fixing pins 172 with its both sides held in contact with the fixing pins 172 (see FIG. 10).

When the user's nail driving operation is not performed, the switch block 183 is placed in the initial position in which the cam follower 185 faces the flat region 179*a* of the flat cam 179. Further, when the user's nail driving operation is performed, the switch block 183 is linearly moved to the connection standby position in which the cam follower 185 can be connected to the cam groove via the electromagnetic solenoid 171 and the switch plate 173 which are described above. When the switch block 183 is moved to the connection standby position and connected to the flat cam 179 via the cam follower 185, the switch block 183 converts rotation of the flat cam 179 into linear motion and transmits it to the cam plate 137. Further, the switch block 183 is constantly biased in a direction toward the initial position from the connection standby position by the biasing spring 187 disposed between the switch block 183 and the body housing 107 (see FIG. 8).

The cam follower 185 disposed in the rear (right as viewed in FIG. 11) end region of the switch block 183 in its extending direction is formed as a columnar pin-like member. The cam follower 185 is mounted to the switch block 183 such that it can move back and forth (slide) in a direction (the direction of the rotational axis of the flat cam 179) transverse to the extending direction (moving direction) of the switch block 183. Further, the cam follower 185 is constantly biased in such a direction that its tip end is brought in contact with the flat region 179*a* of the flat cam 179, by a biasing member in the form of a spring 188. Therefore, in the state in which the cam follower 185 is in the connection standby position, when the tip end 185*a* of the cam follower 185 is aligned with the connecting recess 181*a* of the cam groove 181 as the flat cam 179 rotates, the tip end 185*a* enters the connecting recess 181*a* and then relatively moves along the cam groove 181 and finally moves out of the disconnecting recess 181*b*. Specifically, the switch block 183 is connected to the flat cam 179 by entry of the cam follower 185 into the connecting recess 181*a* of the cam groove 181, while the switch block 183 is disconnected from the flat cam 179 by exit of the cam follower 185 from the disconnecting recess 181*b* of the cam groove 181. The switch block 183 disconnected from the flat cam 179 is returned to the initial position by inertial force and spring force which will be described below. Further, the connecting recess 181*a* and the disconnecting recess 181*b* are contiguously formed with the flat region 179*a* of the flat cam 179 via inclined surfaces (slopes) 181*c* (see FIG. 59) such that the cam follower 185 smoothly moves into the connecting recess 181*a* and smoothly moves out of the disconnecting recess 181*b*.

A wall surface of the cam groove 181 of the flat cam 179 which comes in contact with the cam follower 185 is shaped such that the cam follower 185 (the switch block 183) is linearly moved rearward (toward the rotational axis of the flat cam 179). Specifically, the cam groove 181 has a cam switching region 181*d* and a retaining region 181*e*. The cam switching region 181*d* serves to switch the cam plate 137 from the inoperative position to the operative position by moving the cam follower 185 engaged with the connecting recess 181*a* toward the rotational axis of the flat cam 179 (rearward). The retaining region 181*e* serves to retain the cam plate in the operative position for a predetermined period of time by retaining the cam follower 185 for a predetermined period of time in a position to which the cam follower 185 is moved by the cam switching region 181*d*. The cam switching region 181*d* is shaped to extend in an arcuate form having a radius from the rotational axis of the flat cam 179 which gradually decreases toward the retaining region 181*e* from the connecting recess 181*a*. Further, the retaining region 181*e* is shaped to extend in an arcuate form having a radius from the rotational axis of the flat cam 179 which is substantially uniform toward the disconnecting recess 181*b* from the cam switching region 181*d*.

Therefore, the cam follower 185 connected to the cam groove 181 in the connecting recess 181*a* is moved rearward by relatively rotating in the cam switching region 181*d*. Further, the cam follower 185 is retained in the rearward position for a predetermined period of time by relatively rotating in the retaining region 181*e* and thereafter moved out of the disconnecting recess 181*b* and disconnected from the cam groove 181. Further, in order to accelerate the cam follower 185 radially outward, the cam groove of the disconnecting recess 181*b* is linearly shaped to extend gradually away from the rotational axis of the flat cam 179 in a direction of exit of the cam follower 185. Specifically, a disconnection guiding region 181*f* is provided between the retaining region 181*e* and the disconnecting recess 181*b* and serves to forcibly move the cam follower 185 toward the radially outer disconnecting recess 181*b*. By provision of the disconnection guiding region 181*f*, the cam follower 185 is forcibly moved in the direction (forward) away from the rotational axis of the flat cam 179. Thereafter, the cam follower 185 is moved out of the disconnecting recess 181*b* by inertial force and spring force and returned to its initial position.

The link 189 for connecting the switch block 183 and the cam plate 137 is mounted to the body housing 107 such that its one end can rotate on the shaft 191 in the longitudinal direction (the horizontal direction as viewed in FIG. 11). The link 189 extends toward the cam plate 137 through the switch block 183. Further, the link 189 is connected substantially at its middle in the extending direction to the front end of the switch block 183 by a first connecting pin 192*a* such that it can rotate with respect to the switch block 183. The link 189 is also connected at its front end in the extending direction to the front end of the cam plate 137 by a second connecting pin 192*b*. Further, in order to avoid interference with the switch block 183 which linearly moves, the link 189 which rotates on the shaft 191 is engaged with the shaft 191 via a U-shaped bifurcate portion 189*a* which can move in a direction transverse to an axial direction of the shaft 191 with respect to the shaft 191.

When the switch block 183 is connected to the rotating flat cam 179 via the cam follower 185, the cam plate 137 connected to the switch block 183 via the link 189 is switched from the inoperative position to the operative position as the cam follower 185 relatively moves in the cam switching region 181*d* of the cam groove 181. Further, the cam plate 137 is retained in the operative position for a predetermined period of time as the cam follower 185 relatively moves in the retaining region 181*e* of the cam groove 181. Then the instant when the switch block 183 is disconnected from the flat cam 179, the cam plate 137 is returned to the inoperative position together with the switch block 183.

In this embodiment, timings of connection and disconnection of the switch block 183 with respect to the flat cam 179 are set according to the position of the driving pin 133. Specifically, the timings of connection and disconnection between the switch block 183 and the flat cam 179 are set such that, during one turn of the flywheel 131 and the flat cam 179 which rotate together, the cam plate 137 is moved to the operative position when the driving pin 133 revolving around the rotational axis of the flywheel 131 comes near the cam face 138 of the cam plate 137, while the cam plate 137 is moved to the inoperative position when the driving pin 133 passes over the cam face 138 of the cam plate 137. Therefore, the timings of connection and disconnection between the switch block 183 and the flat cam 179 are held constant with respect to the angular position of the driving pin 133 revolving around the rotational axis of the flywheel 131, regardless of the timing of user's nail driving operation. Specifically, rotation of the flywheel 131 and switching movement of the cam plate 137 to the operative position are synchronized with each other.

Figure 26:
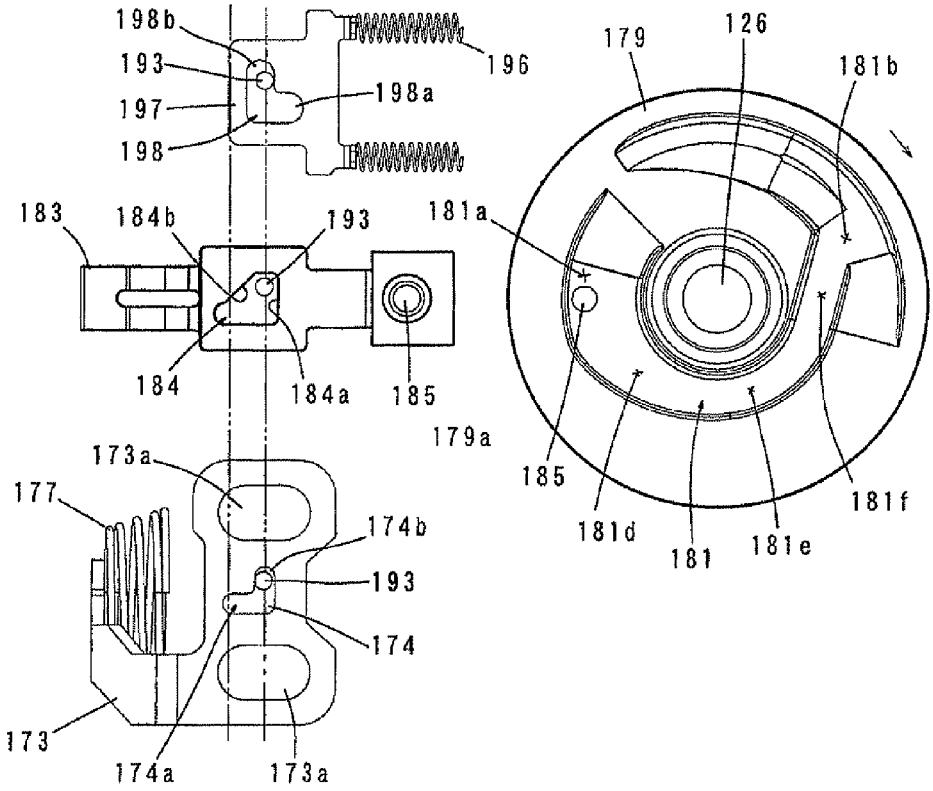
FIG. 26 shows the components of the cam switching mechanism shown disassembled when the flat cam and the switch block are connected to each other.
Figure 27:
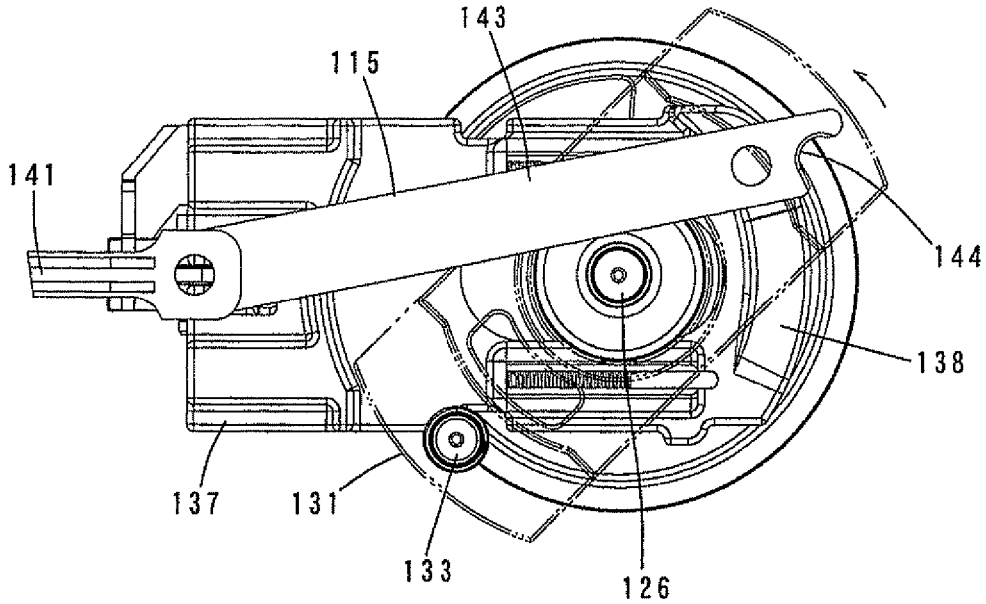
FIG. 27 shows the positional relation between the cam plate and the driving pin when the flat cam and the switch block are connected to each other.
Figure 28:
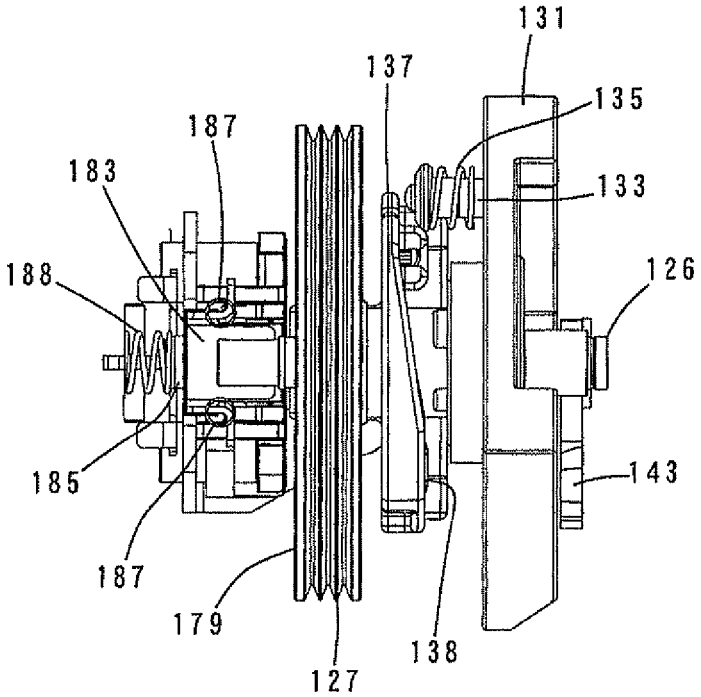
FIG. 28 shows the positional relation between the cam plate and the driving pin when the flat cam and the switch block are connected to each other, as viewed from the right in FIG. 27.
Figure 50:
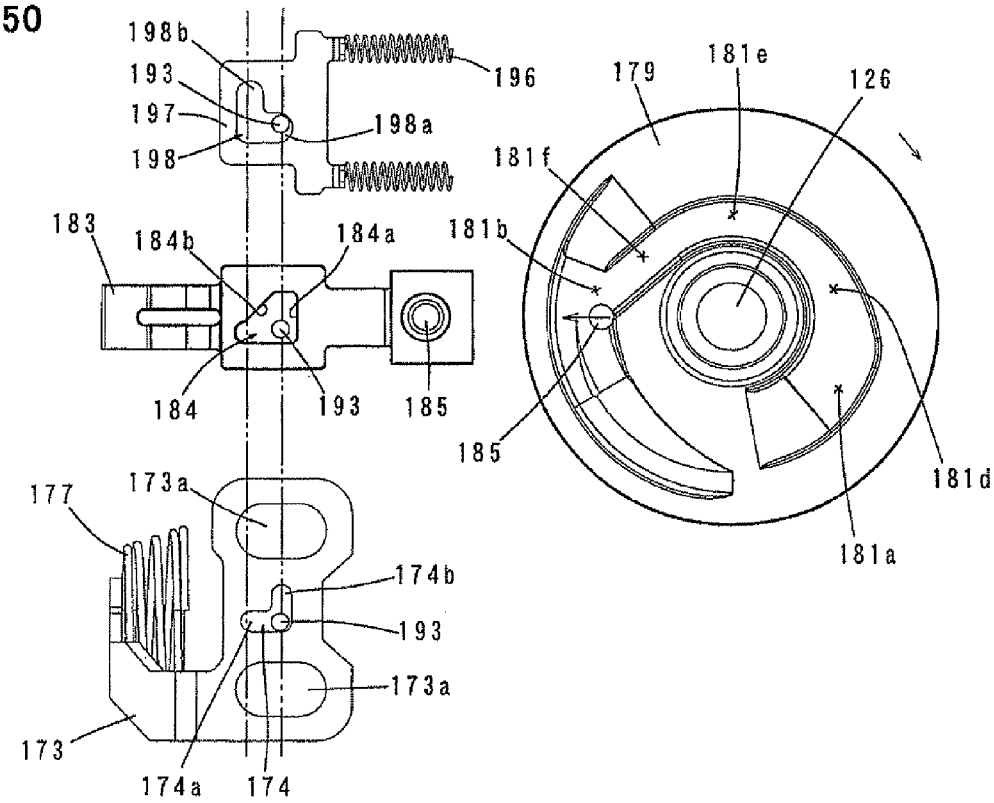
FIG. 50 shows the components of the cam switching mechanism shown disassembled when the switch block is returned.
Figure 51:
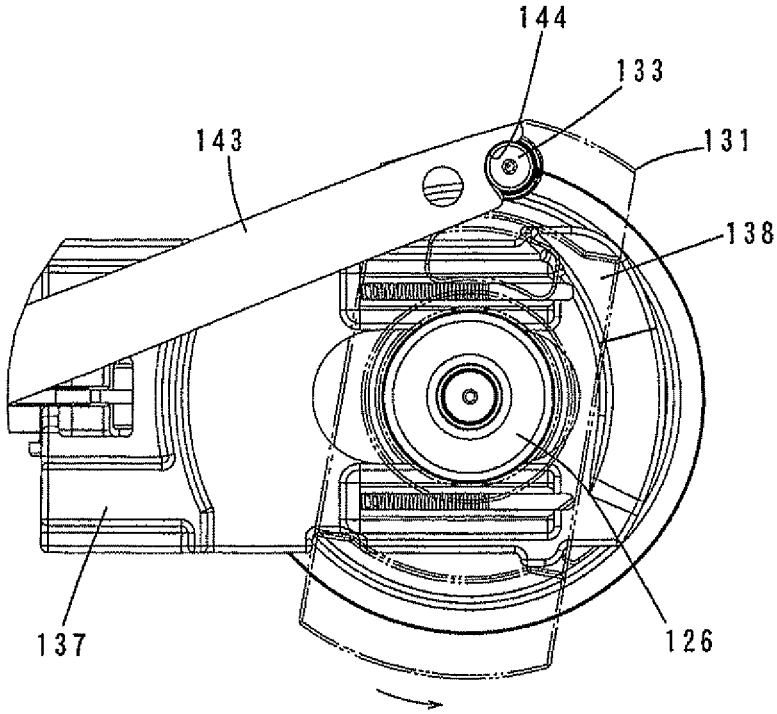
FIG. 51 shows the positional relation between the cam plate and the driving pin when the switch block is returned.
Figure 52:
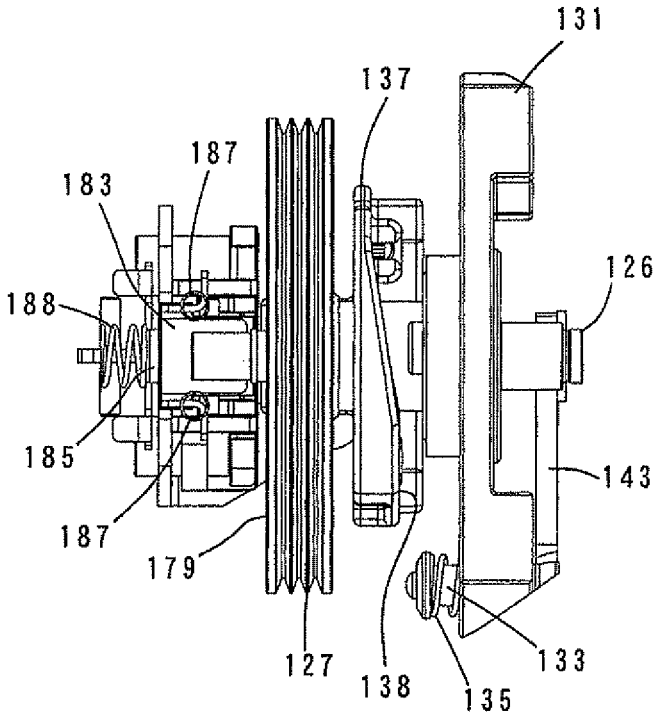
FIG. 52 shows the positional relation between the cam plate and the driving pin when the switch block is returned, as viewed from the right in FIG. 51.

In this embodiment, as shown in FIGS. 26 and 27, it is configured such that connection between the switch block 183 and the flat cam 179 is made at the time when the driving pin 133 revolves toward a position to engage with the C-shaped engagement recess 144 of the link arm 143*c* in the driver mechanism 115 and reaches an angular position of about 180 degrees from this engagement position. The above-described angular position of 180 degrees is a feature that corresponds to the "predetermined angular position" according to this invention. Further, as shown in FIGS. 50 and 51, it is configured such that disconnection between the switch block 183 and the flat cam 179 is made at the time when the driving pin 133 revolves about 60 degrees from the engagement position after engaged with the C-shaped engagement recess 144 of the link arm 143.

Figure 14:
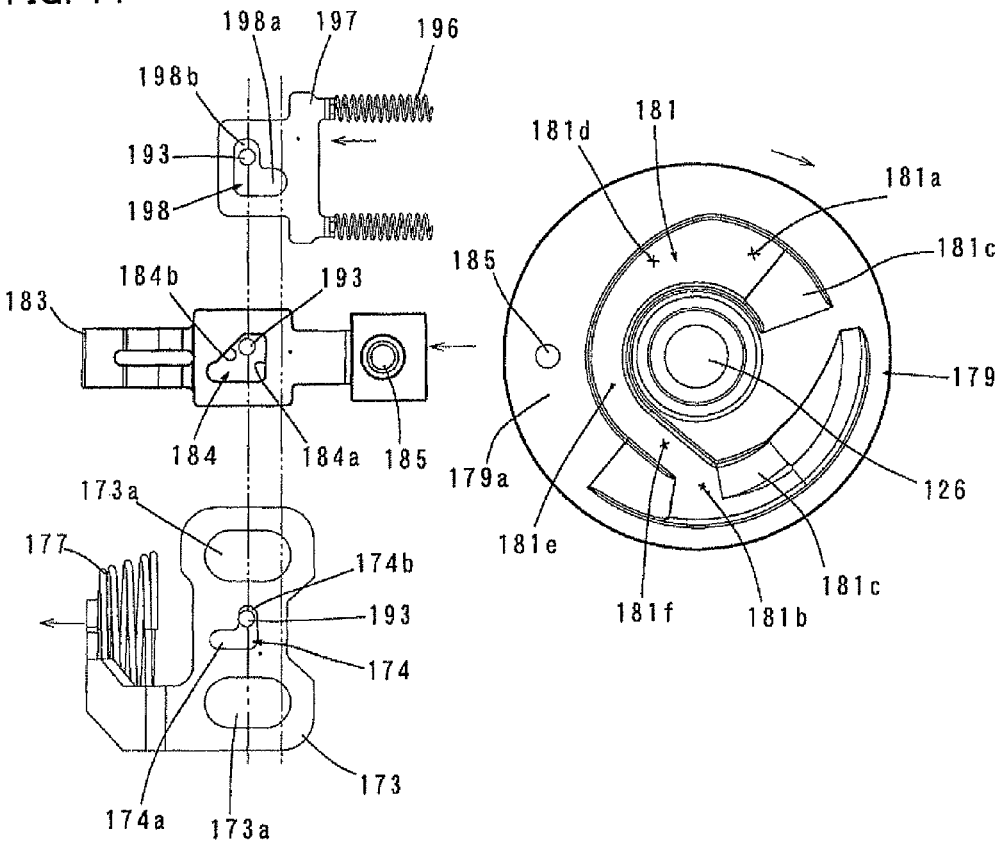
FIG. 14 shows components of the cam switching mechanism shown disassembled in the initial state.

Further, in this embodiment, when the switch block 183 is connected to the flat cam 179 and moved, the switch plate 173 is allowed to move with respect to the switch block 183. For this purpose, as shown in FIG. 14, an inverted L-shaped connection hole 174 is formed in the switch plate 173. The connection hole 174 has a longitudinal hole 174*a* which linearly extends in the longitudinal direction and a lateral hole 174*b* which intersects with a rear end of the longitudinal hole 174*a* and linearly extends therefrom in the lateral direction as viewed from the front. Further, a triangular hole 184 shaped in a generally right-angled triangle is formed in the switch block 183. The connecting pin 193 for connecting the switch plate 173 and the switch block 183 is inserted through the connection hole 174 and the triangular hole 184. A rear wall surface 184*a* of the triangular hole 184 linearly extends in the lateral direction as viewed from the front.

When the user's nail driving operation is not performed, the connecting pin 193 is located in the lateral hole 174*b* of the connection hole 174 of the switch plate 173 and in a position to face the rear wall surface 184*a* of the triangular hole 184 (see FIGS. 13, 14, 19 and 20). In this state, when the switch plate 173 is moved rearward by the movable core 171*a* of the electromagnetic solenoid 171 by the user's nail driving operation, the movement of the switch plate 173 is transmitted to the switch block 183 via the connecting pin 193 and then the switch block 183 is moved from the initial position to the connection standby position. Specifically, the lateral hole 174*a* of the connection hole 174 forms a connecting region for integrating the switch plate 173 with the switch block 183 when the switch plate 173 is moved by the user's nail driving operation.

Figure 31:
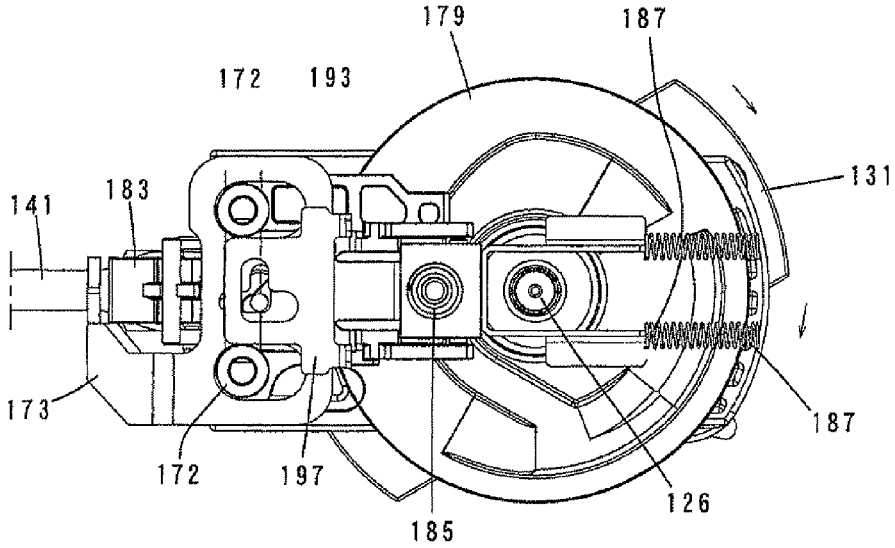
FIG. 31 is a view as viewed from the direction of the arrow I in FIG. 30 when the cam plate is moved to the operative position.
Figure 32:
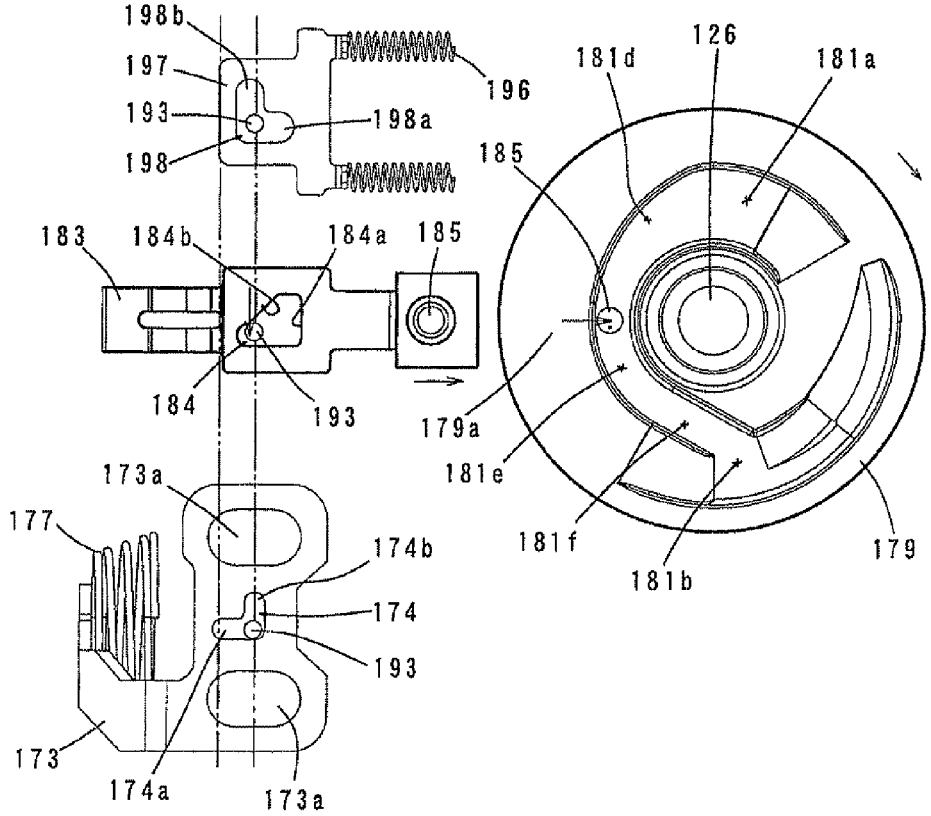
FIG. 32 shows the components of the cam switching mechanism shown disassembled when the cam plate is moved to the operative position.

When the switch block 183 is moved to the connection standby position and then connected to the flat cam 179 and moved by the flat cam 179, the connecting pin 193 is pushed with a front inclined surface 184*b* of the triangular hole 184 by this movement of the switch block 183. As a result, the connecting pin 193 is only moved along the lateral hole 174*b* of the connection hole 174 to the intersection with the longitudinal hole 174*a*, but the switch plate 173 is not caused to move (see FIGS. 31 and 32). Specifically, the front inclined surface 184*b* of the triangular hole 184 is provided as a region for moving the switch plate 173 and the switch block 183 with respect to each other. The connecting pin 193 is a feature that corresponds to the "connecting member" according to this invention. The position in which the connecting pin 193 is located in the lateral hole 174*b* of the connection hole 174 and faces or contacts the rear wall surface 184*a* of the triangular hole 184 is a feature that corresponds to the "third position" according to this invention. Further, the position (region) in which the connecting pin 193 is moved to the intersection in the connection hole 174 by the front inclined surface 184*b* of the triangular hole 184 is a feature that corresponds to the "fourth position" according to this invention. Further, the front inclined surface 184*b* for moving the connecting pin 193 along the lateral hole 174*b* to the intersection with the longitudinal hole 174*a* is a feature that corresponds to the "switching mechanism" according to this invention. Further, the connecting pin 193 is constantly biased by a leaf spring 194 (see FIG. 13) so as to be placed in the lateral hole 174*b* of the connection hole 174 of the switch plate 173. The leaf spring 194 is a feature that corresponds to the "biasing member for biasing the connecting member" according to this invention.

The connecting pin 193 placed in the intersection of the connection hole 174 can be moved forward along the longitudinal hole 174*a* of the connection hole 174. Therefore, even if the switch plate 173 is moved to the rearward position by the electromagnetic solenoid 171 and retained in this position, the switch block 183 disconnected from the flat cam 179 can be returned to the initial position without being prevented by the connecting pin 193.

As shown in FIG. 11, the cam follower 185 is supported to the switch block 183 such that it can rotate around its axis. With such a construction, when the cam follower 185 is connected to the cam groove 181 and relatively moves, the cam follower 185 rolls on the wall surface of the cam groove 181. By thus rolling, the cam follower 185 comes in even contact with the cam groove 181 in the circumferential direction. As a result, local friction of the cam follower 185 with the cam groove 181 is avoided. Further, the cam follower 185 has a pin member 195 extending in a direction transverse to the axial direction of the cam follower 185.

The pin member 195 is engaged with an annular groove 185*b* such that it can move with respect to the annular groove 185*b*. The annular groove 185*b* has an arcuate section and is formed all around the perimeter of the middle of the cam follower 185 in the axial direction. Further, both ends of the pin member 195 in the axial direction protrude to the outside from sides of the switch block 183 through slots 183*a* which are formed in the switch block 183 and extend in the longitudinal direction of the cam follower 185. Further, the mounting member 175 has an inclined surface 175*a* in its rear end region, and when the switch block 183 is in the initial position, the inclined surface 175*a* serves to retract the cam follower 185 away from the flat cam 179 by pushing the both protruded ends of the pin member 195 and hold the cam follower 185 in this retracted position. In this manner, noise which may be caused by movement of the cam follower 185 (rotation of the flat cam 179) with respect to the flat cam 179 is avoided when the tip end 185*a* of the cam follower 185 is held in contact with the flat region 179*a* of the flat cam 179. When the switch block 183 is moved to the connection standby position, the pin member 195 held by the inclined surface 175*a* of the mounting member 175 is released, so that the tip end of the cam follower 185 is allowed to come in contact with the flat cam 179 by spring force. The inclined surface 175*a* of the mounting member 175 is a feature that corresponds to the "releasing means" according to this invention.

Further, in this embodiment, as shown in FIG. 11, a play region C is provided in the connection between the link 189 and the cam plate 137 such that, when the switch block 183 is driven by the electromagnetic solenoid 171 to move from the initial position to the connection standby position, this movement of the switch block 183 is not transmitted to the cam plate 137. Specifically, the second connecting pin 192*b* is mounted to the link 189 and disposed between a front wall surface 137*b* and a rear wall surface 137*c* of the cam plate 137 which are opposed to each other with a predetermined spacing in the longitudinal direction. The second connecting pin 192*b* rotates together with the link 189 on the shaft 191. The second connecting pin 192*b* comes in contact with the front wall surface 137*b* when the switch block 183 is placed in the initial position, while it comes in contact with the rear wall surface 137*c* when the switch block 183 is moved from the initial position to the connection standby position. Therefore, the movement of the switch block 183 from the initial position to the connection standby position is not transmitted to the cam plate 137. The front wall surface 137*b*, the rear wall surface 137*c* and the second connecting pin 192*b* form the "connecting part" according to this invention. Further, the space between the opposed front and rear wall surfaces 137*b*, 137*c* is a feature that corresponds to the "play region" according to this invention.

Further, in this embodiment, a continuous nailing prevention mechanism (safety device) is provided for preventing continuous nailing when the contact arm (not shown) is held pressed against the workpiece and the trigger 157 is held depressed. The continuous nailing prevention mechanism mainly includes a safety plate 197 which serves to control positioning of the connecting pin 193 which connects the switch plate 173 and the switch block 183. The safety plate 197 is a feature that corresponds to the "retaining means" according to this invention.

As shown in FIGS. 11 to 14, the safety plate 197 is overlaid on the back side of the switch plate 173 and supported by the above-described two right and left fixing pins 172 such that it can linearly move in the longitudinal direction. Further, a forward biasing force is constantly exerted on the safety plate 197 by a biasing member in the form of a coil spring 196. An L-shaped pin control hole 198 is formed in the safety plate 197 and has a longitudinal hole 198*a* which linearly extends in the longitudinal direction and a lateral hole 198*b* which intersects with the rear end of the longitudinal hole 198*a* and linearly extends therefrom in the lateral direction. The connecting pin 193 is engaged with the pin control hole 198.

Figure 13:
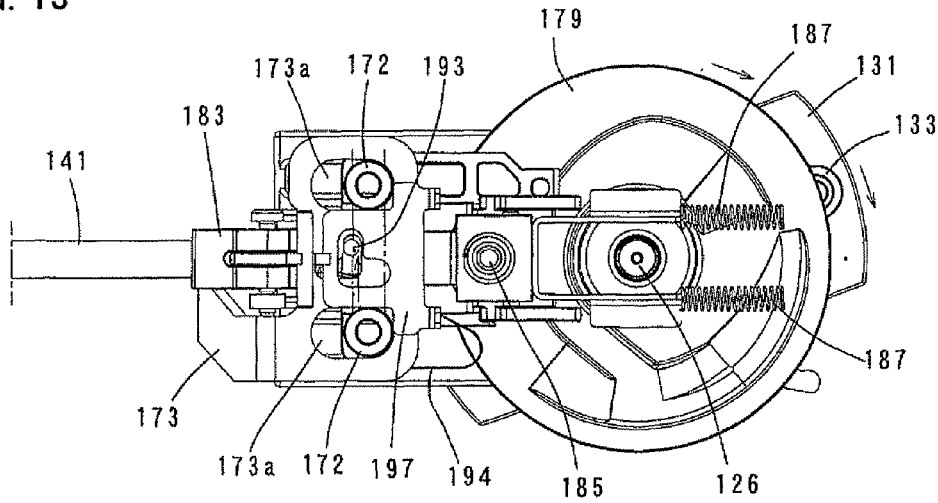
FIG. 13 is a view as viewed from the direction of the arrow F in FIG. 12, in the initial state.
Figure 38:
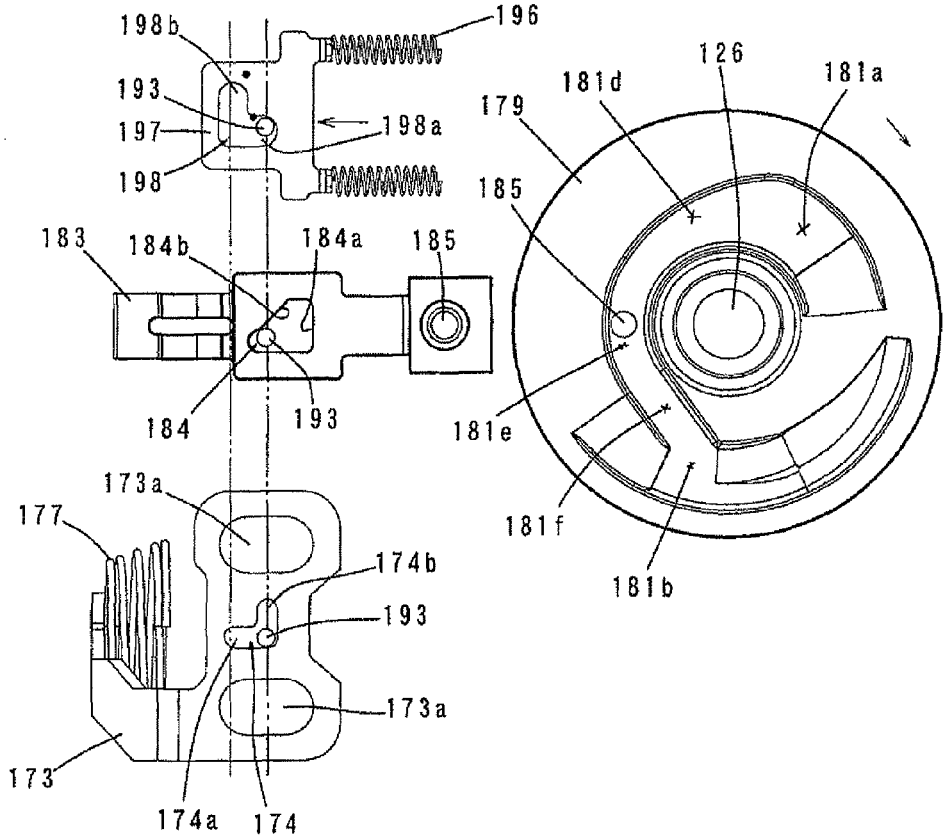
FIG. 38 shows the components of the cam switching mechanism shown disassembled in the operative state of the safety device.
Figure 39:
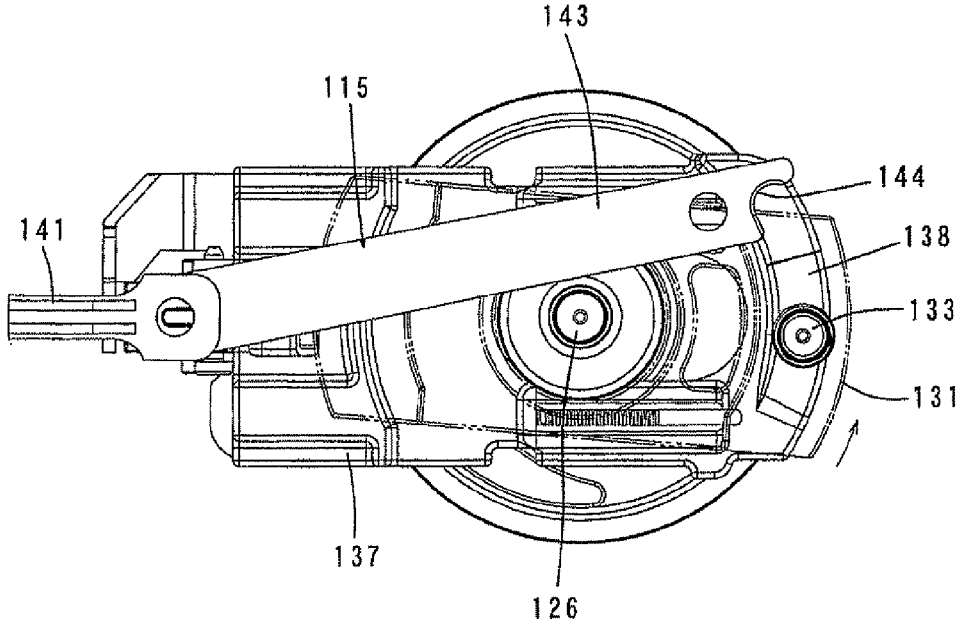
FIG. 39 shows the positional relation between the cam plate and the driving pin in the operative state of the safety device.
Figure 40:
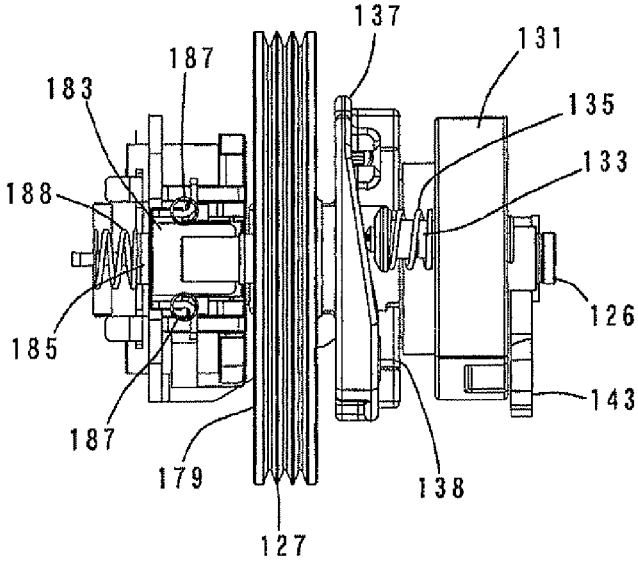
FIG. 40 shows the positional relation between the cam plate and the driving pin in the operative state of the safety device, as viewed from the right in FIG. 39.

When the switch plate 173 is in the initial position, the connecting pin 193 is located in (engaged with) one end (on the side opposite to the intersection) of the lateral hole 198*b* of the pin control hole 198 (see FIGS. 13 and 14). Therefore, when the switch plate 173 is moved rearward upon energization of the electromagnetic solenoid 171 by the user's nail driving operation and moved from the initial position to the connection standby position via the connecting pin 193, the wall of the lateral hole 198*b* of the safety plate 197 is pushed by the connecting pin 193, so that the safety plate 197 is moved rearward together with the switch plate 173. Thereafter, when only the switch block 183 connected to the flat cam 179 is moved rearward (when the cam plate 137 is moved to the operative position), as described above, the connecting pin 193 is pushed by the front inclined surface 184*b* of the triangular hole 184 of the switch block 183 and moved to the intersection along the lateral hole 174*b* of the connection hole 174 of the switch plate 173 and the lateral hole 198*b* of the pin control hole 198 of the safety plate 197 (see FIG. 38). When the connecting pin 193 reaches the intersection, the safety plate 197 is no longer prevented from moving by the connecting pin 193 and moved forward (to the left as viewed in FIG. 38) by spring force while the longitudinal hole 174*a* of the connection hole 174 moves with respect to the connecting pin 193.

Thus, the safety plate 197 prevents the connecting pin 193 from moving (escaping) from the intersection of the connection hole 174 of the switch plate 173 along the lateral hole 174*b*. Specifically, the safety plate 197 holds the connecting pin 193 in the intersection of the connection hole 174. Therefore, when the switch block 183 is disconnected from the flat cam 179 and allowed to be moved to the initial position, the connecting pin 193 is pushed by the rear wall surface 184*a* of the triangular hole 184 of the switch block 183 and moved forward along the longitudinal hole 198*a* of the pin control hole 198 of the safety plate 197 and the longitudinal hole 174*a* of the connection hole 174 of the switch plate 173. Specifically, when the switch block 183 is disconnected from the flat cam 179, the safety plate 197 can reliably return the switch block 183 to the initial position.

In this state, when either one or both of the operation of depressing the trigger 157 and the operation of pressing the contact arm is released and the electromagnetic solenoid 171 is de-energized, the switch plate 173 is returned to the initial position by spring force. Then, the connecting pin 193 which is biased toward the end of the lateral hole 198*b* of the pin control hole 198 by spring force is moved to the end of the lateral hole 198*b* and returned to the initial position as the switch plate 173 is returned to the initial position.

For example, in the state in which the operation of depressing the trigger 157 and the operation of pressing the contact arm against the workpiece are maintained, if the connecting pin 193 is moved toward the lateral hole 174*b* of the switch plate 173 when the switch block 183 is returned to the initial position, the switch block 183 may be left in a connectable position and connected to the flat cam 179 again. According to this embodiment, such an occurrence can be prevented by provision of the safety plate 197. In other words, even if the operation of depressing the trigger 157 is maintained, the nailing operation is not continuously performed.

Figure 35:
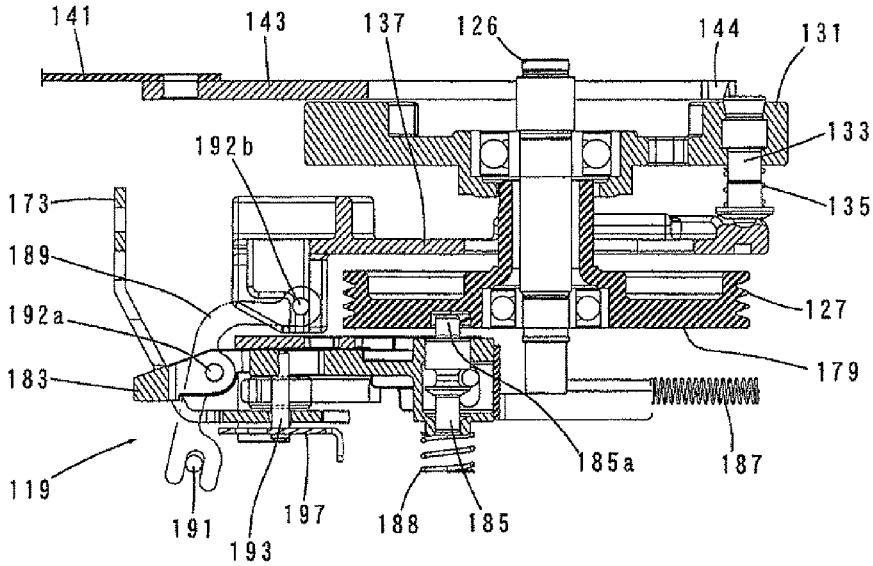
FIG. 35 is a sectional view showing the cam switching mechanism in the operative state of a safety device (safety plate).
Figure 36:
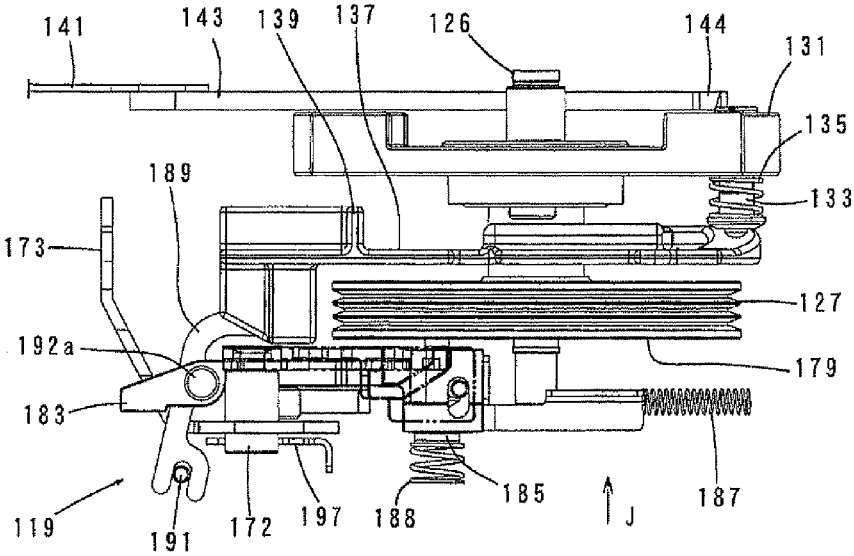
FIG. 36 is an external view showing the cam switching mechanism in the operative state of the safety device.
Figure 37:
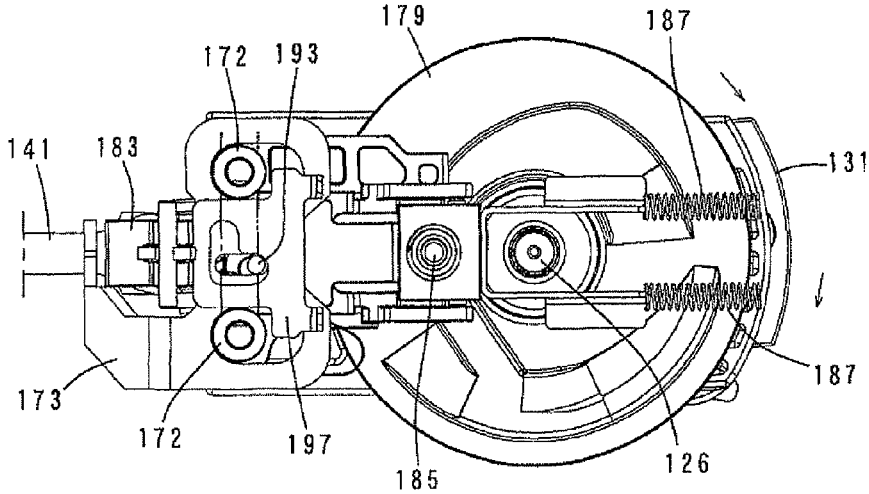
FIG. 37 is a view as viewed from the direction of the arrow J in FIG. 36 in the operative state of the safety device.

A projection 139 for preventing abnormal locking of the cam plate 137 is formed on the cam plate 137 on the side (front end region) opposite to the cam face 138 and protrudes toward the flywheel. As shown in FIGS. 35 and 36, in the state in which the cam plate 137 is placed in the operative position, the distance between the projection 139 and the rotational axis of the flywheel 131 is shorter than the distance between the axes of the flywheel 131 and the driving pin 133. Thus, the projection 139 is configured as a forcible returning member for forcibly returning the cam plate 137 to the inoperative position by interfering (colliding) with the driving pin 133 when the can plate 137 is locked in the operative position for any reason. The projection 139 is a feature that corresponds to the "protrusion of the cam member" according to this invention, and the driving pin 133 which can collide with the protrusion is a feature that corresponds to the "protrusion of the rotating member" according to this invention. Further, as described above, the earn plate 137 is biased toward the inoperative position by the coil spring 132. Therefore, the coil spring 132 serves as a member which forcibly returns the cam plate 137 to the inoperative position when the cam plate 137 is locked in the operative position for any reason. The coil spring 132 is a feature that corresponds to the "spring member" according to this invention.

Operation and usage of the nailing machine 100 constructed as described above is now explained. When the nailing machine 100 is not driven, the driver 141 is held in the standby position by the driver returning mechanism 117. The cam plate 137 is placed in the inoperative position (rearward position) in which the cam face 138 is not opposed to the driving pin 133. The electromagnetic solenoid 171 is held in a de-energized state and the switch block 183 is held in the initial position in which the switch block 183 cannot be connected with the flat cam 179. At this time, the connecting pin 193 is engaged with the lateral hole 174*b* of the connection hole 174 of the switch plate 173 and the lateral hole 198*b* of the pin control hole 198 of the safety plate 197, and held in contact with the rear wall surface 184*a* of the triangular hole 184 of the switch block 183. This initial state is shown in FIGS. 11 to 16.

In such a state, when the user holds the handle 103 and turns the trigger lock lever 161 toward the user, the actuator of the first electronic switch 163 is pushed by the end actuating part 161*a* of the trigger lock lever 161, so that the first electronic switch 163 is turned on and the driving motor 123 is driven. The rotating output of the driving motor 123 is transmitted to the flywheel 131 via the driving V-pulley 125, the V-belt 129, the driven V-pulley 127 and the support shaft 126. Therefore, the flywheel 131 is rotationally driven and stores kinetic energy required for nail driving. Then the driving pin 133 mounted to the flywheel 131 is caused to revolve around the rotational axis of the flywheel 131. At this time, the cam face 138 of the cam plate 137 is held in the inoperative position in which it is not opposed to the rotation path of the driving pin 133, so that the driving pin 133 continues to revolve in the retracted position with respect to the flywheel 131 (separated from the side of the cam plate 137).

Further, the flat cam 179 is caused to rotate together with the driven pulley 127, but the switch block 183 is held in the initial position and it is not connected to the flat cam 179. Thus, the flat cam 179 idles. Further, when the trigger lock lever 161 is turned in order to drive the driving motor 123, the locking part 161*b* of the trigger lock lever 161 is disengaged from the engagement part 157*a* of the trigger 157, so that the trigger 157 is released.

When the trigger 157 is depressed in this state, the actuator of the second electronic switch 155 is pushed, so that the second electronic switch 155 is turned on. Further, when the tip end of the contact arm is pressed against the workpiece, the contact arm is pushed by the workpiece and retracted toward the body housing 107, so that the third electronic switch is turned on. In this manner, when the second electronic switch 155 and the third electronic switch are turned on by user's nail driving operation, the electromagnetic solenoid 171 is energized. FIGS. 17 to 22 show the state immediately after the switches are turned on or immediately after the user's nail driving operation.

When the electromagnetic solenoid 171 is energized and the switch plate 173 is moved rearward together with the movable core 171*a*, the switch block 183 is linearly moved rearward via the connecting pin 193 and moved from the initial position to the connection standby position. Thus, the pin member 195 of the cam follower 185 is disengaged from the inclined surface 175*a* of the mounting member 175 (see FIG. 18). Therefore, the cam follower 185 is moved toward the flat cam 179 by spring force and its tip end is pressed against the flat cam 179. Specifically, when the switch block 183 is moved to the connection standby position, the cam follower 185 is caused to relatively rotate in contact with the flat cam 179. Further, the link 189 is rotated rearward on the shaft 191 as the switch block 183 moves to the connection standby position. At this time, however, the second connecting pin 192*b* only moves between the front and rear wall surfaces 137*b*, 137*c* of the cam plate 137 and the movement of the switch block 183 is not transmitted to the cam plate 137 (see FIG. 17).

Then, when the tip end of the cam follower 185 is aligned with the connecting recess 181*a* of the cam groove 181 of the flat cam 179 by rotation of the flat cam 179 in the direction of the arrow in the drawings, the cam follower 185 biased by spring force enters the connecting recess 181*a*, so that the switch block 183 is connected to the flat cam 179. FIGS. 23 to 28 show the state in which the switch block 183 is connected to the flat cam 179.

When the cam follower 185 enters the connecting recess 181*a* of the cam groove 181, the cam follower 185 is caused to move toward the rotational axis of the flat cam 179 by relatively rotating in the cam switching region 181*d* of the cam groove 181. Thus, the switch block 183 is linearly moved rearward. Therefore, the cam plate 137 connected to the switch block 183 via the link 189 is moved from the inoperative position to the operative position. Specifically, the second connecting pin 192*b* of the link 189 pushes the rear wall surface 137*c* of the cam plate 137 and moves the cam plate 137 to the operative position (forward position).

The cam groove 181 includes the retaining region 181*e* which has a generally uniform radius from the rotational axis of the flat cam 179 and is formed contiguously with the cam switching region 181*d*. With such a construction, while relatively moving within the retaining region 181*e* after passing through the cam switching region 181*d*, the cam follower 185 is held stationary in a position to which it is caused to relatively move by the cam switching region 181*d*. Therefore, while the cam follower 185 relatively rotates in the retaining region 181*e* of the cam groove 181, the cam plate 137 is held stationary (on standby) in the operative position and prepared for entry (engagement) of the driving pin 133. The cam plate 137 on standby is shown in FIGS. 29 to 34.

When the switch block 183 is linearly moved rearward and the cam plate 137 is switched to the operative position, the connecting pin 193 is pushed by the front inclined surface 184*b* of the triangular hole 184 of the switch block 183 and moved toward the intersections within the lateral hole 198*b* of the pin control hole 198 of the safety plate 197 and the lateral hole 174*b* of the connection hole 174 of the switch plate 173. Then when the connecting pin 193 reaches the intersections, the safety plate 197 is moved forward by spring force, so that the connecting pin 193 is placed in the end of the longitudinal hole 198*a* of the pin control hole 198. Therefore, the connecting pin 193 is prevented from moving toward a connecting region (toward the lateral hole 174*b* of the connection hole 174) in which the switch plate 173 and the switch block 183 are integrated by engagement with the longitudinal hole 198*a*. Specifically, the safety device for preventing continuous nailing is activated. This state is shown in FIGS. 35 to 40.

Figure 46:
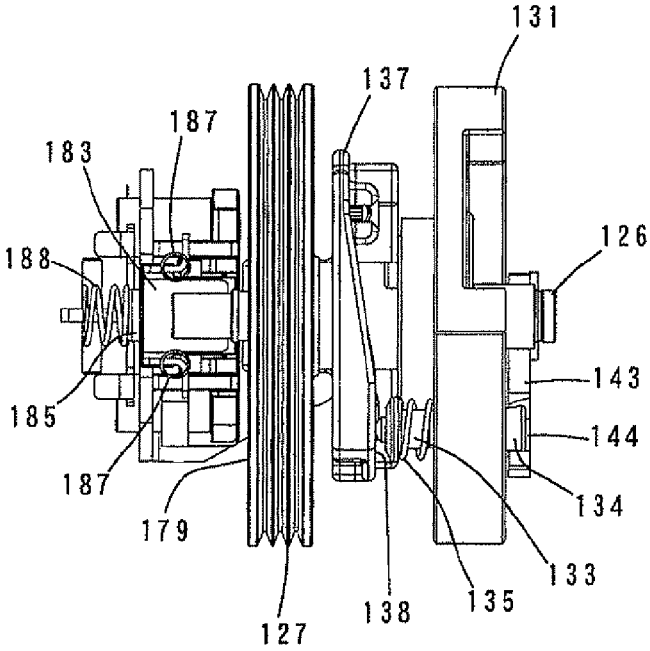
FIG. 46 shows the positional relation between the cam plate and the driving pin at the start of driving movement, as viewed from the right in FIG. 45.
Figure 47:
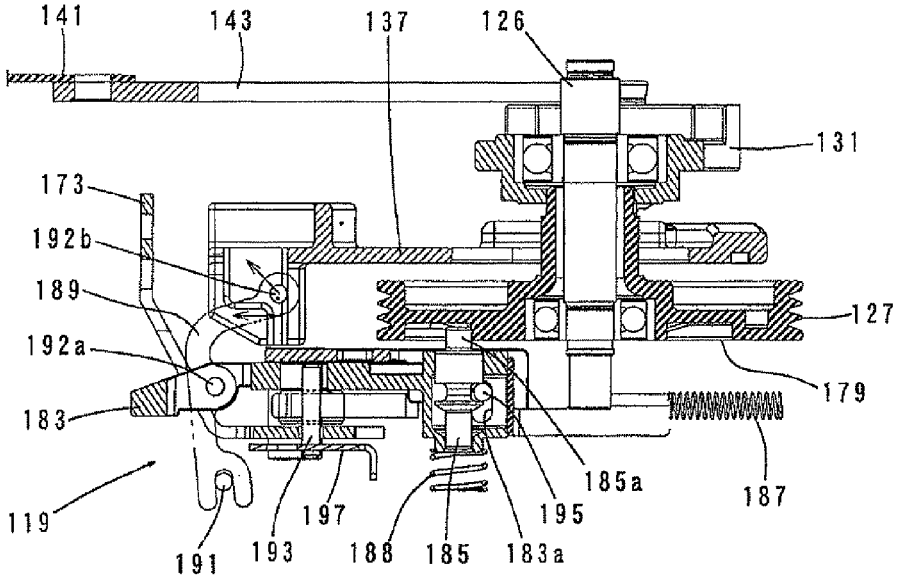
FIG. 47 is a sectional view showing the cam switching mechanism when a switch block is returned.
Figure 48:
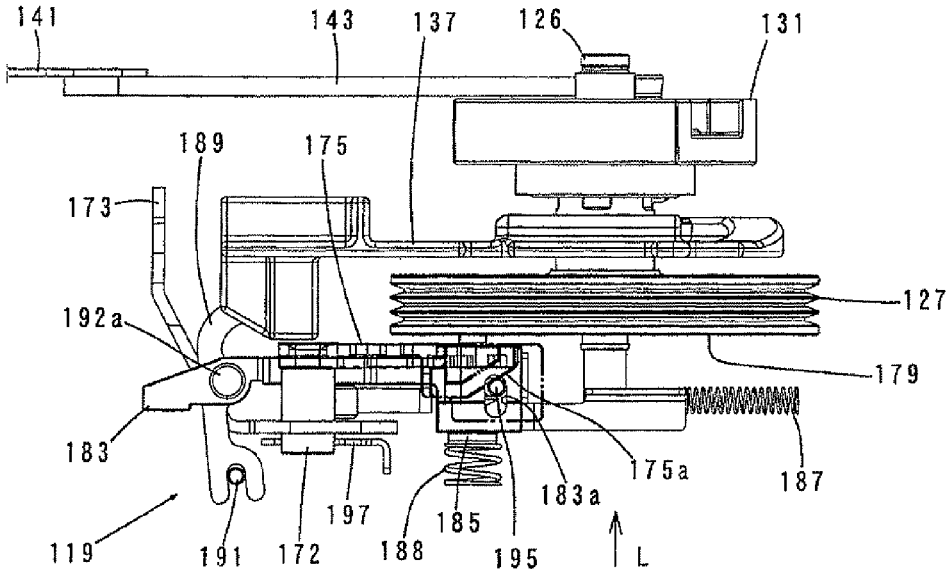
FIG. 48 is an external view showing the cam switching mechanism when the switch block is returned.
Figure 49:
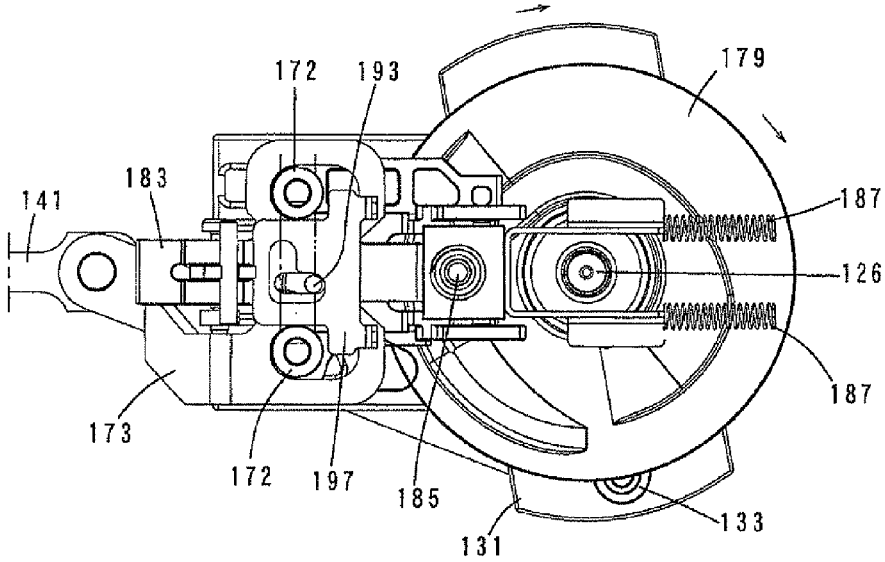
FIG. 49 is a view as viewed from the direction of the arrow L in FIG. 48 when the switch block is returned.

When the cam plate 137 is switched to the operative position in such a manner as described above, the driving pin 133 mounted to the flywheel 131 climbs onto the cam face 138 and protrudes from the front side of the fly wheel 131 against the spring force of the coil spring 135 (see FIGS. 41 and 46). At this time, the protruding end or engagement protrusion 134 of the driving pin 133 is engaged with the C-shaped engagement recess 144 of the link arm 143 which is placed in the standby position in the driver mechanism, through the opening from the radial direction (see FIG. 45). This engagement is maintained by both of tapered surfaces of the engagement protrusion 134 and the C-shaped engagement recess 144 against the biasing force of the coil spring 135 even after the driving pin 133 passes over the cam face 138. The starting condition of the nail driving movement of the driver mechanism is shown in FIGS. 41 to 46.

When the driving pin 133 passes over the cam face 138 of the cam plate 137, the cam follower 185 relatively moves from the retaining region 181*e* to the disconnecting recess 181*b* in the cam groove 181. In this embodiment, a linearly extending disconnection guiding region 181*f* is provided between the retaining region 181*e* and the disconnecting recess 181*b* and serves to forcibly move the cam follower 185 toward the radially outer disconnecting recess 181*b*. Therefore, the cam follower 185 is accelerated radially outward by the disconnection guiding region 181*f* and forcibly moved toward the disconnecting recess 181*b*. Thereafter, the cam follower 185 is moved out of the disconnecting recess 181*b* by inertial force and spring force. Thus, the switch block 183 is separated (disconnected) from the flat cam 179 and moves toward the initial position. Therefore, the cam plate 137 connected to the switch block 183 via the link 189 is also moved to return to the inoperative position. The switch block 183 on the way back to the initial position is shown in FIGS. 47 to 52.

Further, when the link arm 143 is engaged with the driving pin 133 and moved forward by revolution of the driving pin 133, the driver 141 is caused to linearly move forward, so that it strikes a nail with its tip end and drives the nail into the workpiece. At this time, the coil spring 151 is deformed in the tightening direction via the guide pin 147 moving together with the link arm 143 and thus stores elastic energy.

Upon completion of the nail driving movement of the driver 141, the engagement protrusion 134 of the driving pin 133 moves radially out of the opening of the C-shaped engagement recess 144 of the link arm 143. In this manner, the link arm 143 disengaged from the driving pin 133 is returned to the standby position together with the driver 141 by the coil spring 151.

Figure 53:
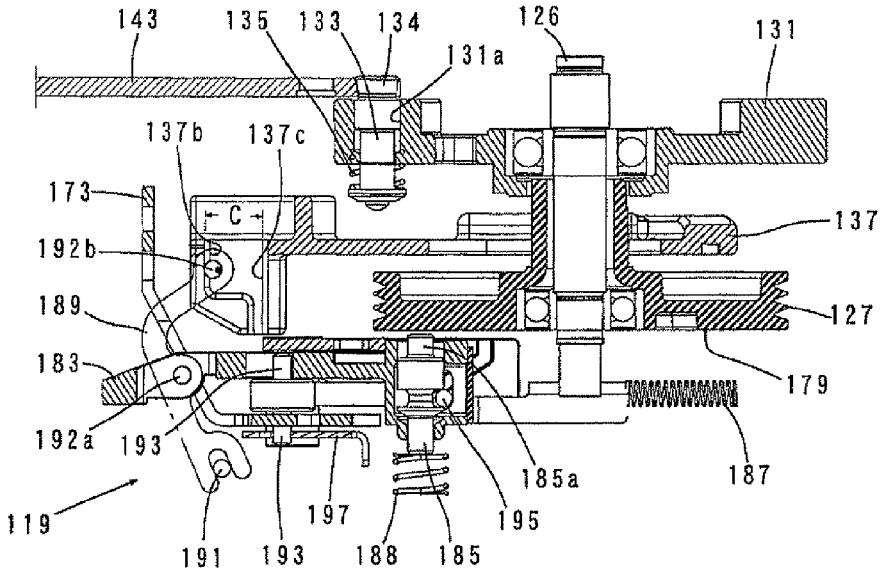
FIG. 53 is a sectional view showing the cam switching mechanism at the completion of driving movement.
Figure 54:
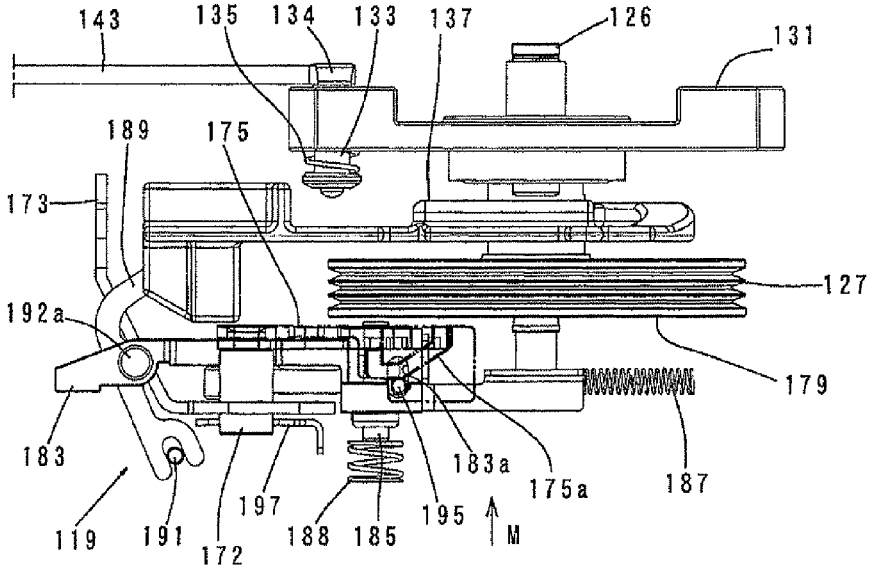
FIG. 54 is an external view showing the cam switching mechanism at the completion of driving movement.
Figure 55:
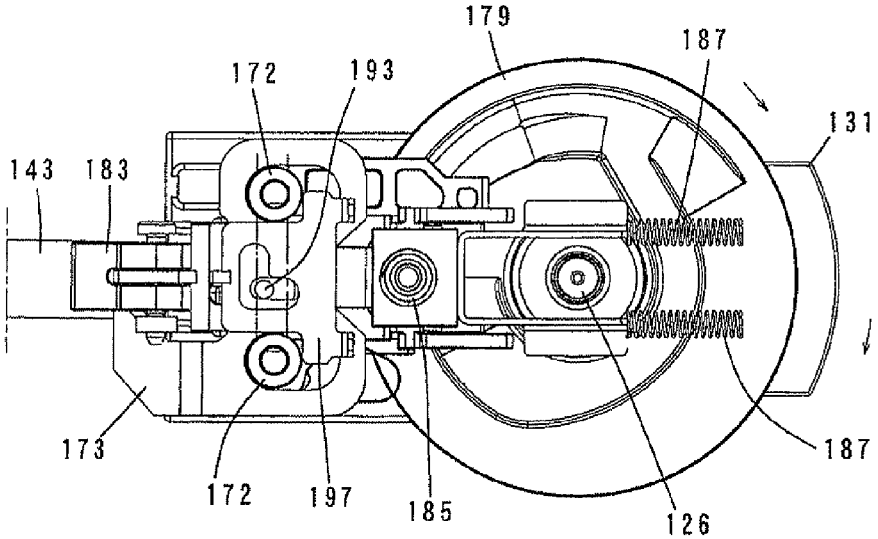
FIG. 55 is a view as viewed from the direction of the arrow M in FIG. 54 at the completion of driving movement.
Figure 56:
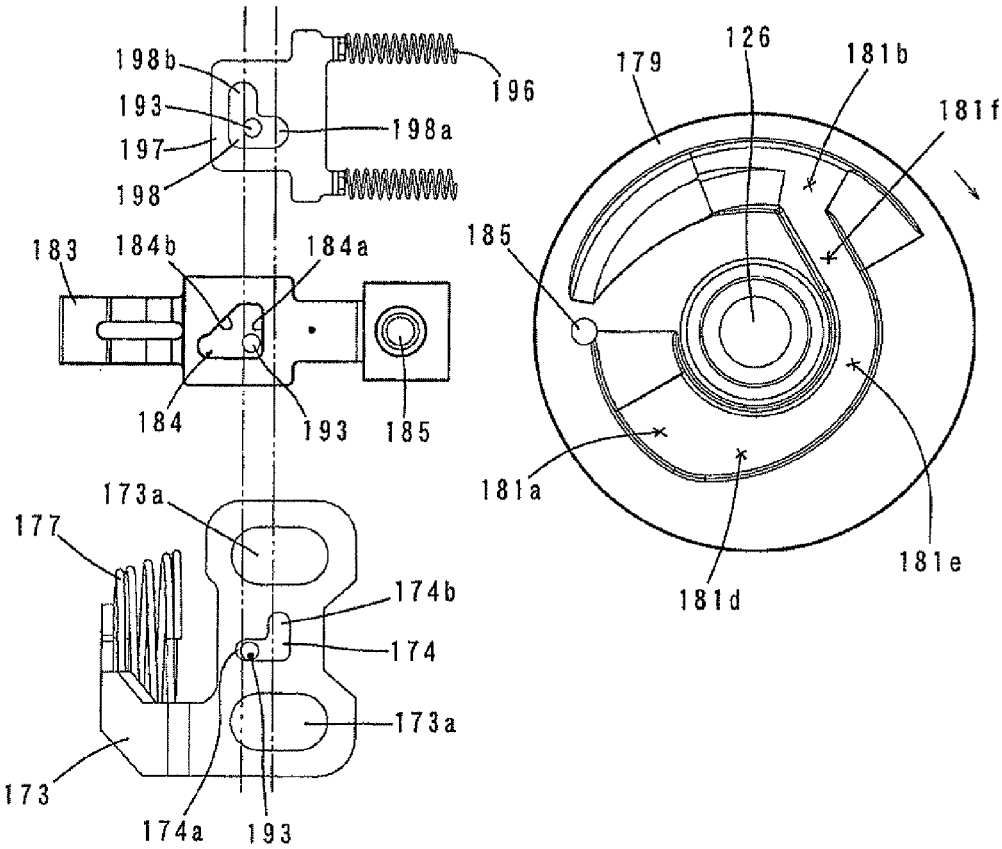
FIG. 56 shows the components of the cam switching mechanism at the completion of driving movement.
Figure 57:
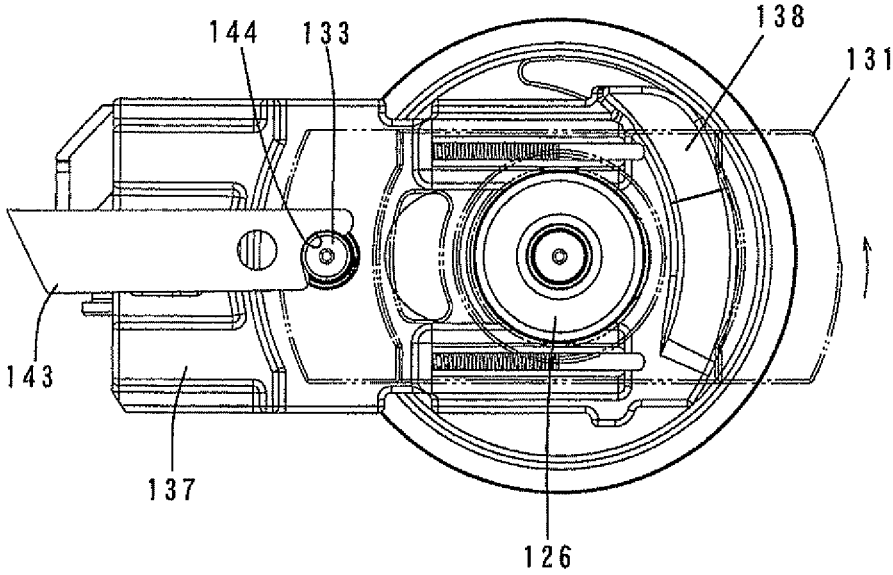
FIG. 57 shows the positional relation between the cam plate and the driving pin at the completion of driving movement.
Figure 58:
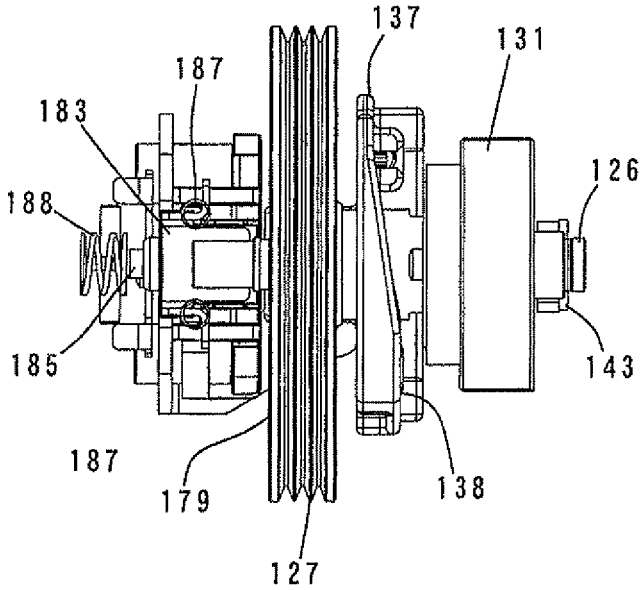
FIG. 58 shows the positional relation between the cam plate and the driving pin at the completion of driving movement, as viewed from the right in FIG. 57.

Further, when the switch block 183 is completely returned to the initial position, the connecting pin 193 is pushed forward by the rear wall surface 184*a* of the triangular hole 184 of the switch block 183. Specifically, the connecting pin 193 is moved toward the intersection with the lateral hole 198*b* within the longitudinal hole 198*a* of the pin control hole 198 of the safety plate 197 and also moved toward the end within the longitudinal hole 174*a* of the connection hole 174 of the switch plate 173. The state in which the nail driving movement is completed is shown in FIGS. 53 and 58.

When the operation of depressing the trigger 157 or pressing the contact arm against the workpiece is released after completion of the nail driving movement of the driver 141, the electromagnetic solenoid 171 is de-energized, so that the switch plate 173 is returned to the initial position by spring force. When the switch plate 173 is returned to the initial position, the connecting pin 193 relatively moves toward the intersection with the lateral hole 174*b* within the longitudinal hole 174*a* of the connection hole 174. Further, when the connecting pin 193 reaches the intersection, the connecting pin 193 moves toward the end of the lateral hole 174*b* by spring force, so that the connecting pin 193 returns to the initial state (see FIGS. 13 and 14). Thus, one cycle of the nail driving movement is completed.

In order to perform a continuous nailing operation, for example, a nail driving location is changed by once moving the contact arm away from the workpiece while holding the trigger 157 in the depressed position, and then the contact arm is pressed against the workpiece again. At this time, both the second electronic switch 155 and the third electronic switch are turned on, so that the electromagnetic solenoid 171 is energized. Alternatively, the operation of depressing the trigger 157 is released and then a nail driving location is changed by sliding the contact arm on the workpiece while pressing the contact arm against the workpiece, and thereafter the trigger 157 is depressed again. At this time, both the second electronic switch 155 and the third electronic switch are also turned on, so that the electromagnetic solenoid 171 is energized. In this manner, the nailing operation by the driver 141 as described above can be performed.

As described above, according to this embodiment, the nail driving movement of the driver mechanism 115 can be continuously performed while the flywheel is held rotationally driven. Therefore, continuous nail driving movement can be more quickly performed compared with the known nailing machine in which, each time a nailing operation is performed, the motor is driven to rotationally drive the flywheel 131 and nail driving movement starts only after the flywheel 131 reaches a rotational speed required to secure kinetic energy. Specifically, continuous nailing can be realized, so that working efficiency can be improved.

In this embodiment, when the nail driving operation is performed in the state in which the flywheel 131 is rotationally driven, the switch block 183 is moved to the connection standby position in which it can be connected to the flat cam 179. Then, when the driving pin 133 which rotates around the rotational axis of the flywheel 131 is placed in a predetermined rotational angular position, the switch block 183 is connected to the flat cam 179. Therefore, the timing of connection between the switch block 183 and the flat cam 179 is held constant with respect to the rotational angular position of the driving pin 133 which revolves around the rotational axis of the flywheel 131, regardless of the timing of user's nail driving operation. Therefore, it is not necessary to control the timing of user's nail driving operation, so that stable nail driving movement can be realized.

Further, in this embodiment, with the construction in which the play region C is provided between the cam plate 137 and the switch block 183 such that the cam plate 137 is not moved while the switch block 183 moves at least from the initial position to the connection standby position, the stroke of the cam plate 137 can be reduced, so that space savings within the nailing machine can be realized.

Further, in this embodiment, when the switch block 183 is in the initial position, the cam follower 185 is held in non-contact with the flat cam 179. Therefore, noise which may be caused when the cam follower 185 relatively rotates in contact with the flat cam 179 can be prevented and unnecessary wear of the cam follower 185 can be avoided.

Further, in this embodiment, the cam plate 137 has the forcible returning member in the form of the projection 139, and in the event that the cam plate 137 is locked in the operative position for any reason and not returned to the inoperative position even though the switch block 183 is separated from the flat cam 179, the driving pin 133 strikes the projection 139 by utilizing rotation of the driving pin 133 around the rotational axis of the flywheel 131 and forcibly returns the cam plate 137 to the initial position. With this construction, continuous nailing which may be caused if the cam plate 137 is left in the operative position can be reliably prevented. Further, a striking part which serves to forcibly return the projection 139 may be provided separately from the driving pin 133.

Further, in this embodiment, when the switch block 183 connected to the flat cam 179 is moved toward the rotational axis of the flat cam 179, the connecting pin 193 connecting the switch plate 173 and the switch block 183 is pushed by the front inclined surface 184*b* of the triangular hole 184 of the switch block 183 and moved toward the intersection along the lateral hole 174*b* of the connection hole 174 of the switch plate 131. With this construction, the switch plate 173 and the switch block 183 are allowed to move with respect to each other and at the same time, the connecting pin 193 is allowed to move forward along the longitudinal hole 174*a* of the connection hole 174. Therefore, when the switch block 183 is separated from the flat cam 179, even during the user's operations of pressing the contact arm against the workpiece and depressing the trigger 157, the switch block 183 can be returned to the initial position. As a result, continuous nailing is prevented. Furthermore, in this embodiment, with the construction in which the safety plate 197 is provided to prevent the connecting pin 193 from moving in the direction that integrates the switch plate 173 and the switch block 183 with each other, the above-described prevention of continuous nailing can be further ensured.

Further, in this embodiment, the nailing machine 100 is explained as a representative example of the driving tool according to the invention, but the invention may also be applied to a driving tool such as a tucker and a stapler, other than the nailing machine.

Further, in view of the scope and spirit of the invention, the following features can be provided.

Aspect 1:

The driving tool as defined in claim 3, wherein the play region provided between the cam member and the cam switching member includes a space having a predetermined length and extending in the longitudinal direction of the cam member and a connecting pin which is movably disposed within the space.

Aspect 2:

The driving tool as defined in claim 6, wherein the protrusion of the rotating member is formed by a pin-like member that serves as the driving member for the driving mechanism which is disposed in the rotating member.

DESCRIPTION OF NUMERALS

100 nailing machine (driving tool)
101 body
103 handle
105 magazine
105*a* pressure plate
106 front cover
107 body housing
107A cover plate
107*a* guide hole
107*b* guide hole
109 motor housing
110 battery pack
111 power transmitting mechanism
113 driver driving mechanism
115 driver mechanism (driving mechanism)
117 driver returning mechanism
119 cam switching mechanism
121 driver guide
121*a* driving hole
123 driving motor (motor)
123*a* output shaft
125 driving V-pulley
126 support shaft
127 driven V-pulley
129 V-belt
131 flywheel (rotating member)
131*a* through hole
132 coil spring (biasing member)
133 driving pin (driving member for the driving mechanism, pin)
134 engagement protrusion
135 coil spring (biasing member)
136 spring receiver
137 cam plate (cam member)
137*a* escape hole
137*b* front wall surface
137*c* rear wall surface
138 cam face (slope)
139 projection (protrusion)
141 driver
143 link arm
144 C-shaped engagement recess (engagement recess)
145 connecting pin
147 guide pin
149 stopper pin
151 coil spring
153 wheel
155 second electronic switch
156 shaft
157 trigger
157*a* engagement part
157*b* return spring
161 trigger lock lever
161*a* end actuating part
161*b* locking part
163 first electronic switch
165 return spring
167 pivot
171 electromagnetic solenoid
171*a* movable core
172 fixing pin
173 switch plate
173*a* slot
174 connection hole
174*a* longitudinal hole
174*b* lateral hole
175 mounting member
175*a* inclined surface (releasing means)
177 spring
179 flat cam (rotationally driven element)
179*a* flat region
181 cam groove
181*a* connecting recess
181*b* disconnecting recess
181*c* inclined surface (slope)
181*d* cam switching region
181*e* retaining region
181*f* disconnection guiding region
183 switch block (cam switching member)
183*a* slot
184 triangular hole
184*a* rear wall surface
185 cam follower
185*a* tip end
185*b* annular groove
187 biasing spring
188 spring
189 link
189*a* bifurcate portion
191 shaft
192*a* first connecting pin
192*b* second connecting pin
193 connecting pin (connecting member)

194 leaf spring
195 pin member
196 coil spring (biasing member)
197 safety plate (retaining means)
198 pin control hole
198*a* longitudinal hole
198*b* lateral hole

I claim:

1. A driving tool comprising:

a motor, a rotating member that is constantly rotationally driven by the motor, a driving member for a driving mechanism that is disposed in the rotating member in a position displaced a predetermined distance from a rotational axis of the rotating member and can be moved in a direction of the rotational axis, the driving member being caused to move between the first position and the second position different from the first position in the direction of the rotational axis, a biasing member that biases the driving member for the driving mechanism in such a manner as to hold the driving member in the second position, a cam member that can be moved between an inoperative position and an operative position in a direction transverse to a direction of movement of the driving member for the driving mechanism, wherein, when the cam member moves from the inoperative position to the operative position, the cam member comes in contact with a predetermined area of the driving member in its longitudinal direction which revolves around the rotational axis of the rotating member and moves the driving member for the driving mechanism to the first position against a biasing force of the biasing member, and further when the cam member moves from the operative position to the inoperative position, the cam member allows the driving member for the driving mechanism to be moved to the second position by the biasing member, a cam switching mechanism which performs a switching movement to move the cam member from the inoperative position to the operative position when a user's driving operation is performed and further to return the cam member from the operative position to the inoperative position, and a driving mechanism that mechanically engages with the driving member for the driving mechanism and performs a movement of driving a material to be driven when the driving member for the driving mechanism is moved to the first position by the cam member, wherein:

the cam switching mechanism has a rotationally driven element that rotates together with the rotating member and a cam switching member that can be connected to and disconnected from the rotationally driven element, wherein, when the cam switching member is connected to the rotationally driven element, the cam switching member performs a switching movement to convert rotation of the rotationally driven element to linear motion and move the cam member from the inoperative position to the operative position and further to return the cam member from the operative position to the inoperative position, and when the cam member is returned to the inoperative position, the cam switching member is disconnected from the rotationally driven element, and when the user's driving operation is performed, the cam switching member is moved to a connection standby position in which the cam switching member can be connected to the rotationally driven element, and when the driving member for the driving mechanism is placed in a predetermined rotational angular position in the direction of rotation of the rotating member, the cam switching member is connected to the rotationally driven element.

2. The driving tool as defined in claim 1, wherein the rotationally driven element comprises a flat cam having a side with a cam groove, and the cam switching member is normally placed in an initial position in which it is disconnected from the cam groove, and when the user's driving operation is performed, the cam switching member is moved from the initial position to a connection standby position in which it can be connected to the cam groove, and when the driving member for the driving mechanism is placed in a predetermined rotational angular position in the direction of rotation of the rotating member in the connection standby position, the cam switching member is connected to the cam groove.

3. The driving tool as defined in claim 2, comprising:

a connecting part for connecting the cam member and the cam switching member, wherein the connecting part has a play region in which the switching movement of the cam switching member is not transmitted to the cam member while the cam switching member is moved from the initial position to the connection standby position.

4. The driving tool as defined in claim 2, wherein the cam switching member is designed to be moved between the initial position and the connection standby position in a direction parallel to the side of the flat cam and has a cam follower in an area opposed to the side of the flat cam, and the cam follower can move in the direction of the rotational axis of the flat cam and is constantly pressed and biased toward the side of the flat cam, further comprising a releasing means, wherein, when the cam switching member is moved to the initial position, the releasing means disconnects the cam follower from the side of the flat cam and holds the cam follower in the disconnected position, and when the cam switching member is moved to the connection standby position, the releasing means releases the cam follower held in the disconnected position.

5. The driving tool as defined in claim 4, wherein the cam follower is supported to the cam switching member and can rotate around its longitudinal axis.

6. The driving tool as defined in claim 1, wherein:

the cam member has a protrusion which protrudes in a direction transverse to the direction of its movement, the rotating member has a protrusion which protrudes in a direction of its rotational axis, and when the cam member is locked in the operative position even though the cam switching member is returned to the initial position, the protrusion of the rotating member comes in contact with the protrusion of the cam member and thereby forcibly moves the cam member to the inoperative position.

7. The driving tool as defined in claim 1, comprising:

a spring member that constantly biases the cam member in order to move the cam member from the operative position to the inoperative position, wherein:

when the cam member is locked in the operative position even though the cam switching member is returned to the initial position, the cam member is forcibly moved to the inoperative position by the spring member.

8. The driving tool as defined in claim 2, wherein the cam switching mechanism further includes:

a movable member that moves the cam switching member from the initial position to the connection standby position by moving in one direction when the user's nail driving operation is performed, a connecting member that is placed in a third position in which the movable member and the cam switching member are integrated, and when the cam switching member is connected to the flat cam, the connecting member can be displaced to a fourth position different from the third position while allowing the movable member and the cam switching member to move with respect to each other, a switching mechanism that holds the connecting member in the third position when the movable member is moved in one direction, and moves the connecting member from the third position to the fourth position when the cam switching member is connected to the flat cam and performs the switching movement.

9. The driving tool as defined in claim 8, comprising:

a retaining means that retains the connecting member in the fourth position until the cam switching member is disconnected from the flat cam and returned to the initial position and the movable member is returned to an initial state by releasing of the user's driving operation, and that allows the connecting member to move to the third position when the movable member is returned to the initial state, and a biasing member that biases the connecting member to be moved from the fourth position to the third position.

10. The driving tool as defined in claim 3, wherein the play region provided between the cam member and the cam switching member includes a space having a predetermined length and extending in the longitudinal direction of the cam member and a connecting pin which is movably disposed within the space.

11. The driving tool as defined in claim 6, wherein the protrusion of the rotating member is formed by a pin-like member that serves as the driving member for the driving mechanism which is disposed in the rotating member.

* * * * *